US008689758B2

(12) United States Patent
Nakamura

(10) Patent No.: US 8,689,758 B2
(45) Date of Patent: Apr. 8, 2014

(54) STARTER CONTROL APPARATUS

(75) Inventor: Ryouta Nakamura, Handa (JP)

(73) Assignee: Denso Corporation, Kariya (JP)

( * ) Notice: Subject to any disclaimer, the term of this patent is extended or adjusted under 35 U.S.C. 154(b) by 234 days.

(21) Appl. No.: 13/364,461

(22) Filed: Feb. 2, 2012

(65) Prior Publication Data

US 2012/0216768 A1 Aug. 30, 2012

(30) Foreign Application Priority Data

Feb. 28, 2011 (JP) ..... 2011-042669

(51) Int. Cl.
*F02N 11/08* (2006.01)
*F02N 11/10* (2006.01)

(52) U.S. Cl.
CPC ..... *F02N 11/0814* (2013.01); *F02N 11/0848* (2013.01)
USPC ..... 123/179.3; 701/107

(58) Field of Classification Search
CPC ..... F02N 11/0848; F02N 11/0814
USPC ..... 123/179.3, 179.4, 179.1; 701/107, 112, 701/113
See application file for complete search history.

(56) References Cited

U.S. PATENT DOCUMENTS

| | | | | |
|---|---|---|---|---|
| 3,744,467 | A * | 7/1973 | Wagner | 123/179.3 |
| 5,239,954 | A * | 8/1993 | Boegner et al. | 123/179.3 |
| 2005/0236900 | A1 | 10/2005 | Kahara et al. | |
| 2010/0090526 | A1 | 4/2010 | Itou | |
| 2010/0299053 | A1 | 11/2010 | Okumoto et al. | |

FOREIGN PATENT DOCUMENTS

| | | |
|---|---|---|
| JP | 08-261119 | 10/1996 |
| JP | 09-329074 | 12/1997 |
| JP | 10-220328 | 8/1998 |
| JP | 11-30139 | 2/1999 |
| JP | 2003-247478 | 9/2003 |
| JP | 2005-307851 | 11/2005 |
| JP | 2008-111343 | 5/2008 |
| JP | 2010-270674 | 12/2010 |
| JP | 2010-275923 | 12/2010 |

* cited by examiner

*Primary Examiner* — Mahmoud Gimie
(74) *Attorney, Agent, or Firm* — Nixon & Vanderhye P.C.

(57) ABSTRACT

An ECU for controlling a starter includes a transistor in addition to transistors, which turn on relays provided for a pinion gear and a motor of the starter, respectively. The transistor is provided in a current path, which connects a line of a battery voltage and a junction between upstream side ends of coils of the relays. The ECU operates the starter by turning on the three transistors, which turn on the relays. It further detects abnormality based on voltages of terminals.

15 Claims, 8 Drawing Sheets

FIG. 4

| | T3 | T1 | T2 | COMP OUTPUT | NORMAL | UPSTREAM OF PINION & MOTOR DRIVE RELAY COIL | | | | DOWNSTREAM OF PINION DRIVE RELAY COIL (FIRST COIL) | | | | DOWNSTREAM OF MOTOR DRIVE RELAY COIL (SECOND COIL) | | | |
|---|---|---|---|---|---|---|---|---|---|---|---|---|---|---|---|---|---|
| | | | | | | (f) | (c) | (g) | (l) | (d) | (a) | (h) | (j) | (e) | (b) | (i) | (k) |
| | | | | | | PWR SHT, T3 ON FAIL | GND SHT | BRK | T3 OFF FAIL | PWR SHT | GND SHT, T1 ON FAIL | BRK | T1 OFF FAIL | PWR SHT | GND SHT, T2 ON FAIL | BRK | T2 OFF FAIL |
| CHECK DRIVE MODE (1) | OFF | OFF | OFF | CM3 | Lo | Hi | Lo | Hi | Lo | Hi | Lo | Lo | Lo | Hi | Lo | Lo | Lo |
| | | | | CM2 | Hi | Hi | Lo | Lo | Hi | Hi | Lo | Hi | Hi | Hi | Lo | Lo | Hi |
| | | | | CM1 | Hi | Hi | Lo | Lo | Hi | Hi | Lo | Lo | Hi | Hi | Lo | Hi | Hi |
| CHECK DRIVE MODE (2) | OFF | ON | OFF | CM3 | Lo | Hi | Lo | Hi | Lo | Hi | Lo | Lo | Lo | Lo | Lo | Lo | Lo |
| | | | | CM2 | Lo | Hi | Lo | Lo | Lo | Hi | Lo | Hi | Hi | Hi | Lo | Lo | Lo |
| | | | | CM1 | Lo | Lo | Lo | Lo | Lo | Hi | Lo | Lo | Hi | Lo | Lo | Lo | Lo |
| CHECK DRIVE MODE (3) | OFF | OFF | ON | CM3 | Lo | Hi | Lo | Hi | Lo | Lo | Lo | Lo | Lo | Hi | Lo | Lo | Lo |
| | | | | CM2 | Lo | Lo | Lo | Lo | Lo | Lo | Lo | Lo | Lo | Hi | Lo | Lo | Hi |
| | | | | CM1 | Lo | Hi | Lo | Lo | Lo | Hi | Lo | Lo | Lo | Hi | Lo | Hi | Hi |
| CHECK DRIVE MODE (4) | ON | OFF | OFF | CM3 | Hi | Hi | Lo | Hi | Lo | Hi | Hi | Hi | Hi | Hi | Hi | Hi | Hi |
| | | | | CM2 | Hi | Hi | Lo | Lo | Hi | Hi | Hi | Hi | Hi | Hi | Lo | Lo | Hi |
| | | | | CM1 | Hi | Hi | Lo | Lo | Hi | Hi | Lo | Lo | Hi | Hi | Hi | Hi | Hi |
| CLASSIFICATION OF ABNORMALITY | | | | | — | [1] | [2] | [3] | [6] | [1] | [2] | [4] | [7] | [1] | [2] | [5] | [8] |

··· T1, T2 AND T3 HAVE SELF-PROTECTIVE AND TURN OFF AT OVER-CURRENT

FIG. 5

| ABNORMALITY | FAILURE MODE | FAIL-SAFE PROCESSING |
|---|---|---|
| [1] | POWER SUPPLY SHORT<br>· COIL UPSTREAM (f)<br>· FIRST COIL DOWNSTREAM (d)<br>· SECOND COIL DOWNSTREAM (e)<br>T3 ON-FAILURE (f) | · USER CAUTION (STARTER CIRCUIT POWER SHORT)<br>· PROHIBITION OF IDLE-STOP<br>* NO IDENTIFICATION OF FAILURE LOCATION BECAUSE OF CIRCUIT SHORT TO POWER |
| [2] | GND SHORT<br>· COIL UPSTREAM (c)<br>· FIRST COIL DOWNSTREAM (a)<br>· SECOND COIL DOWNSTREAM (b)<br>T1 ON-FAILURE (a)<br>T2 ON-FAILURE (b) | · USER CAUTION (STARTER CIRCUIT GROUND SHORT)<br>· PROHIBITION OF IDLE-STOP<br>* NO IDENTIFICATION OF FAILURE LOCATION BECAUSE OF CIRCUIT SHORT TO GROUND |
| [3] | WIRE BREAK<br>· COIL UPSTREAM (g) | · USER CAUTION (WIRE BREAK AT RELAY COIL UPSTREAM)<br>· PROHIBITION OF IDLE-STOP |
| [4] | WIRE BREAK<br>· FIRST COIL DOWNSTREAM (h) | · USER CAUTION (WIRE BREAK AT PINION DRIVE RELAY DOWNSTREAM)<br>· PROHIBITION OF IDLE-STOP |
| [5] | WIRE BREAK<br>· SECOND COIL DOWNSTREAM (i) | · USER CAUTION (WIRE BREAK AT MOTOR DRIVE RELAY COIL DOWNSTREAM)<br>· PROHIBITION OF IDLE-STOP |
| [6] | T3 OFF-FAILURE (l) | · USER CAUTION (OFF-FAILURE OF RELAY COIL UPSTREAM TRANSISTOR)<br>· PROHIBITION OF IDLE-STOP |
| [7] | T1 OFF-FAILURE (j) | · USER CAUTION (OFF-FAILURE OF PINION DRIVE RELAY DRIVE TRANSISTOR)<br>· PROHIBITION OF IDLE-STOP |
| [8] | T2 OFF-FAILURE (k) | · USER CAUTION (OFF-FAILURE OF MOTOR DRIVE RELAY DRIVE TRANSISTOR)<br>· PROHIBITION OF IDLE-STOP |

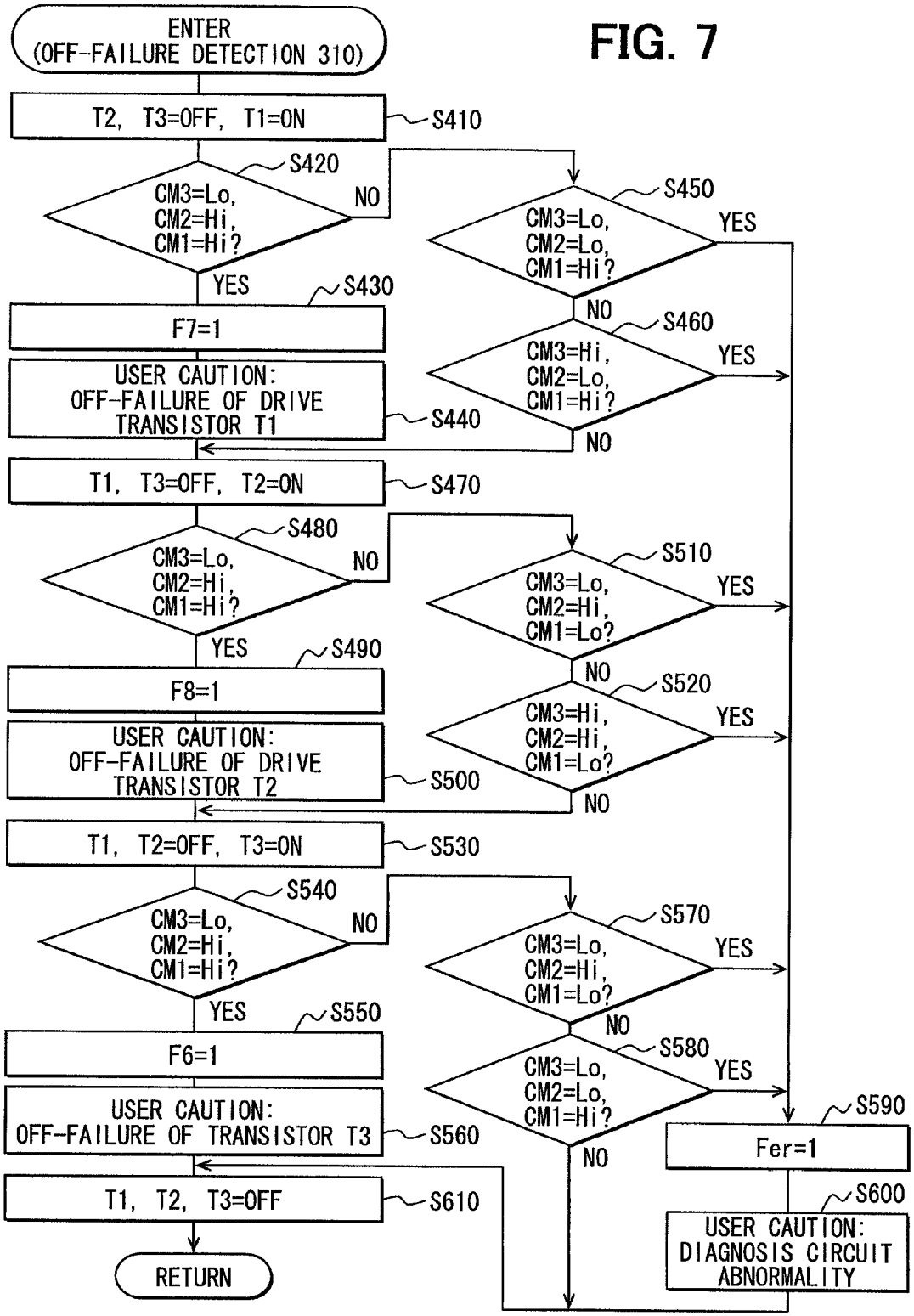
FIG. 7
ENTER
(OFF-FAILURE DETECTION 310)
T2, T3=OFF, T1=ON
S410
S420
CM3=Lo,
CM2=Hi,
CM1=Hi?
NO
YES
S430
F7=1
USER CAUTION:
OFF-FAILURE OF DRIVE
TRANSISTOR T1
S440
S450
CM3=Lo,
CM2=Lo,
CM1=Hi?
YES
NO
S460
CM3=Hi,
CM2=Lo,
CM1=Hi?
YES
NO
T1, T3=OFF, T2=ON
S470
S480
CM3=Lo,
CM2=Hi,
CM1=Hi?
NO
YES
S490
F8=1
USER CAUTION:
OFF-FAILURE OF DRIVE
TRANSISTOR T2
S500
S510
CM3=Lo,
CM2=Hi,
CM1=Lo?
YES
NO
S520
CM3=Hi,
CM2=Hi,
CM1=Lo?
YES
NO
T1, T2=OFF, T3=ON
S530
S540
CM3=Lo,
CM2=Hi,
CM1=Hi?
NO
YES
S550
F6=1
USER CAUTION:
OFF-FAILURE OF TRANSISTOR T3
S560
S570
CM3=Lo,
CM2=Hi,
CM1=Lo?
YES
NO
S580
CM3=Lo,
CM2=Lo,
CM1=Hi?
YES
NO
S590
Fer=1
S600
USER CAUTION:
DIAGNOSIS CIRCUIT
ABNORMALITY
T1, T2, T3=OFF
S610
RETURN

STARTER CONTROL APPARATUS

CROSS REFERENCE TO RELATED APPLICATION

This application is based on and incorporates herein by reference Japanese patent application No. 2011-42669 filed on Feb. 28, 2011.

TECHNICAL FIELD

The present disclosure relates to a starter control apparatus, which cranks an internal combustion engine of a vehicle for engine starting.

BACKGROUND ART

A conventional starter for starting an internal combustion engine of a vehicle (patent document 1: JP 11-30139A) is configured to be switchable between two states irrespective of operation/non-operation of its motor. In one state, a pinion gear driven to rotate by the motor is engaged with a ring gear of the engine. In the other state, the pinion gear is not engaged with the ring gear. This starter is referred to as an independently-controlled starter, since the pinion gear and the motor are controllable independently.

Specifically, in an independently-controlled starter 1 exemplarily shown in FIG. 9, a pinion gear 2 is driven to rotate by a starter motor (motor for a starter) 4 under a state that it is engaged with a ring gear 3 of an internal combustion engine (not shown) so that the engine is cranked by rotation of the ring gear 3. This type of starter 1 is provided with a solenoid (pinion control solenoid) 5 and a power supply relay 6 separately. The pinion control solenoid 5 drives the pinion gear 2 for engagement with the ring gear 3. The power supply relay 6 supplies power to the starter motor 4 to for driving the motor 4.

In the field of electric technology, a coil of a solenoid is often referred to as a solenoid. However, in the following description, it is referred to such that a solenoid means an actuator, which includes a coil and a movable part operated by electromagnetic force of the coil. The power supply relay 6 is a relay of large current capacity and has a coil 6*a* and a pair of fixed contacts 6*b* and 6*c*. When a current is supplied to the coil 6*a* from a battery (power source) 7, the contacts 6*b* and 6*c* are shorted to the on-state by a movable contact to supply a current to the motor 4 from the battery 7 through the contacts 6*b* and 6*c*.

It is generally necessary to supply a relatively large current to each of the coil 5*a* of the pinion control solenoid 5 and the coil 6*a* of the power supply relay 6. The coils 5*a* and 6*a* are thus supplied with currents through two relays, a pinion drive relay RY1 and a motor drive relay RY2, respectively.

More specifically, one end of the coil 5*a* of the pinion control solenoid 5 and one end of the coil 6*a* of the power supply relay 6 are connected to a ground line in a vehicle (generally, vehicle chassis). The pinion drive relay RY1 is provided at an upstream (positive) side of the coil 5*a* and the motor drive relay RY2 is provided at an upstream (positive) side of the coil 6*a*. Through the relays RY1 and RY2, a battery voltage (voltage of the battery 7) VB is supplied as a power source voltage to the upstream sides of the coils 5*a* and 6*a*, which are opposite to the ground line, so that the currents are supplied to each of the coils 5*a* and 6*a*. An electric power supply circuit is thus formed in the vehicle.

One end (positive side end) of each of coils L1 and L2 of the relays RY1 and RY2 is connected to a line 8 of the battery voltage VB. An electronic control circuit 9, which controls the starter 1, is provided with transistors T1 and T2. The transistor T1 is for switching over connection and non-connection between the other end (negative side end) of the coil L1 and the ground line. The transistor T2 is for switching over connection and non-connection between the other end (negative side end) of the coil L2 and the ground line.

By turning on the two transistors T1 and T2 in the control circuit 9, the relays RY1 and RY2 are turned on to supply the currents to the coil 5*a* of the pinion control solenoid 5 and the coil 6*a* of the power supply relay 6 from the relays RY1 and RY2, respectively, so that the pinion gear 2 is driven to engage with the ring gear 3 and the motor 4 is driven to rotate. The engine is thus cranked by the starter 1.

According to the circuit configuration of patent document 1, the starter motor is supplied with the current through one relay controlled by a signal produced from the control circuit. However, since a large current is supplied to the starter motor 4 in practice, the power supply relay 6 of large current supply capacity is provided inside the starter 1 as shown in FIG. 9. The current is supplied to the coil 6*a* of the power supply relay 6 through the relay RY2, which is controlled by the control circuit 9.

The patent document 1 also discloses an engine automatic stop and start system (generally referred to as an idle-stop or idling-stop system), which automatically stops an internal combustion engine in a predetermined stop condition and thereafter automatically start the engine in a predetermined start condition. In a vehicle, which is provided with the idle-stop system and referred to as an idle-stop vehicle, it is likely that an independently-controlled starter is used. According to the independently-controlled starter, it is possible to control a pinion gear to be engaged with a ring gear of an internal combustion engine before starting of a starter motor for example, so that wear of mechanical parts such as the pinion gear is reduced and prolong life of the starter. The independently-controlled starter is therefore suitable for the idle-stop vehicle.

In the control circuit 9, which is exemplified in FIG. 9, if an on-failure (continuation of on-state) of the transistor T1 arises, the pinion drive relay RY1 continues to be turned on and the pinion gear 2 continues to be engaged with the ring gear 3. This causes wasteful electric power consumption. Further, since the pinion gear 2 is continuously rotated by drive force of the engine, the pinion gear 2 and other parts such as a one-way clutch provided in the starter 1 wear. The one-way clutch is provided to prevent the motor 4 from being rotated by the ring gear 3 even when the pinion gear 2 is rotated by the ring gear 3 under a state (non-operation state) that no current is supplied to the motor 4. In addition, if an on-failure arises in the transistor T2, the motor drive relay RY2 continues to be turned on and the motor 4 continues to operate. It is thus likely that the motor 4 overheats and becomes inoperative in addition to wasteful power consumption.

SUMMARY

It is an object to reduce continued engagement of a pinion gear and a ring gear or continued operation of a motor by a starter control apparatus, which controls an independently-controlled starter. The continued engagement and the continued operation are caused when abnormality arises in a circuit, which turns on a relay for engaging the pinion gear to the ring gear of an internal combustion engine and a relay for operating the motor.

According to a first aspect, a starter control apparatus is provided for a vehicle, in which a starter cranks an engine when a first relay and a second relay are turned on. The starter includes a motor and a pinion gear, which is driven to rotate by the motor to crank the engine under a state of engagement with a ring gear of the engine. The pinion gear is switchable to a state of engagement with the ring gear and a state of non-engagement with the ring gear irrespective of an operation and non-operation of the motor. The first relay includes a first coil, which is supplied with a power source voltage at one end thereof, and turns on with supply of the power source voltage to drive the pinion gear to the state of engagement with the ring gear. The second relay includes a second coil, which is connected to the one end of the first coil at one end thereof, and turns on with supply of the power source voltage to drive the motor to operate.

The starter control apparatus comprises a first switching part, a second switching part and an operation preventing switching part. The first switching part is provided in a first current path connecting other end of the first coil, which is opposite to the one end of the first coil, and a ground line, and turns on to render the first current path conductive thereby supplying current in the first coil to turn on the first relay. The second switching part is provided in a second current path connecting other end of the second coil, which is opposite to the one end of the second coil, and the ground line, and turns on to render the second current path conductive thereby supplying current in the second coil to turn on the second relay. The operation preventing switching part is provided in a third current path connecting a power source voltage line and a junction of the one ends of the first coil and the second coil, and turns off to render the third current path non-conductive thereby preventing an operation of the starter. The first switching part, the second switching part and the operation preventing switching part are turned on to turn on the first relay and the second relay so that the starter cranks the engine.

According to a second aspect, a starter control apparatus is provided for controlling an engine starter, which has a motor and a pinion gear separately controllable, by using a first relay and a second relay. The first relay controls the pinion gear of the engine starter, and the second gear is provided electrically in parallel relation to the first relay and controls the motor. The starter control apparatus comprises a first switch, a second switch and an operation preventing switch. The first switch is provided at an electrically downstream side of the first relay and turns on to turn on the first relay. The second switch is provided at an electrically downstream side of the second relay an turns on to turn the second relay. The operation preventing switch is provided at an upstream side of the first relay and the second relay and turns off to interrupt power supply to the first relay and the second relay for preventing an operation of the starter. All of the first switch, the second switch and the operation preventing switches are turned on to turn on the first relay and the second relay for driving the starter to crank the engine.

BRIEF DESCRIPTION OF THE DRAWINGS

The above and other objects, features and advantages of a starter control apparatus will become more apparent from the following detailed description made with reference to the drawings. In the drawings:

FIG. 4 is a table showing combinations of abnormality contents, transistor drive states and comparator outputs in the first embodiment;

FIG. 5 is a table showing contents of fail-safe processing in the first embodiment;

FIG. 7 is a flowchart showing off-failure detection processing executed in the abnormality detection processing in the first embodiment;

DETAILED DESCRIPTION OF THE PREFERRED EMBODIMENTS

A starter control apparatus for a vehicle implemented as an electronic control unit (hereinafter referred to as ECU) will be described below.

First Embodiment

Figure 1:
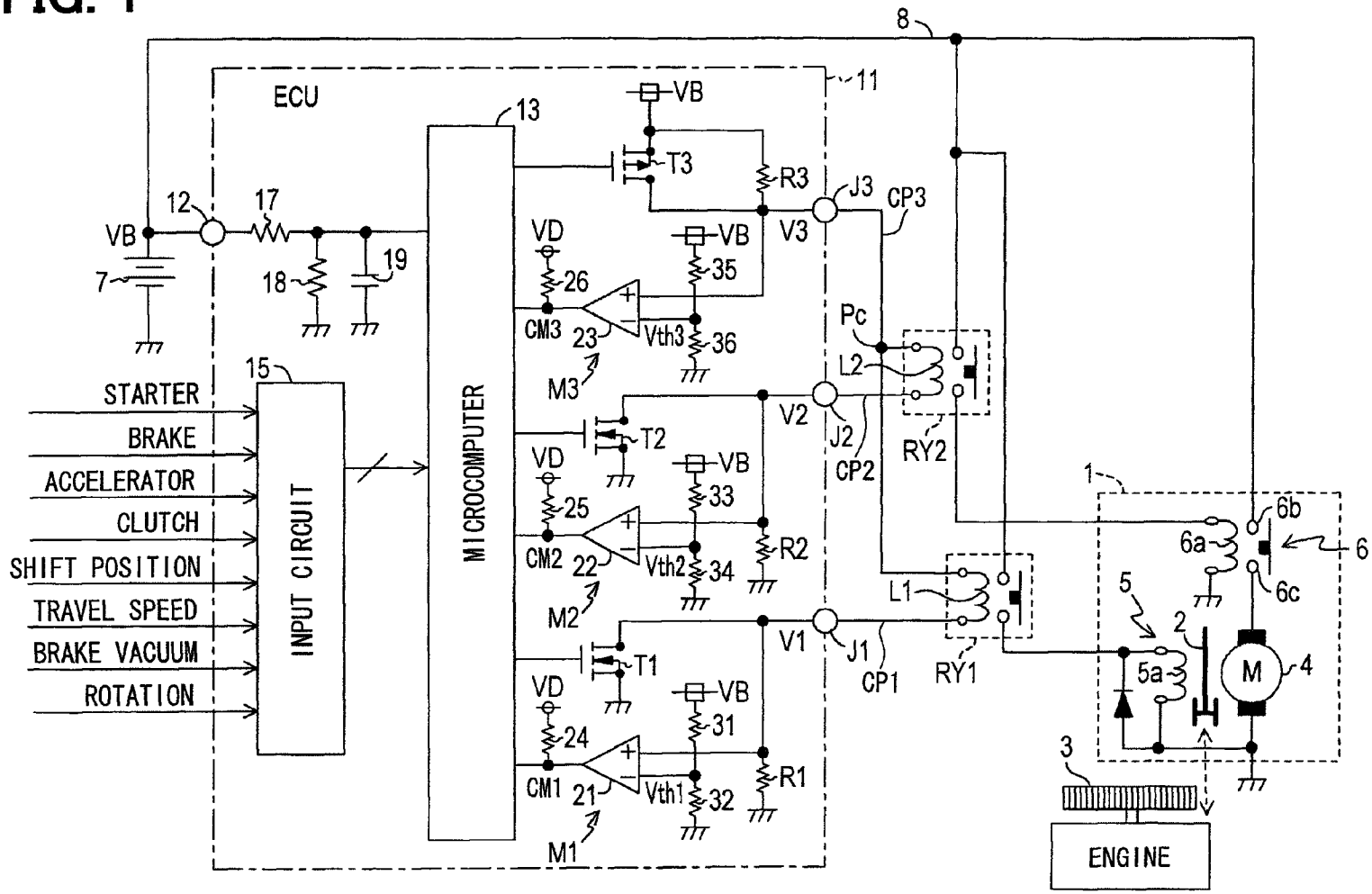
FIG. 1 is a circuit diagram showing an ECU and its peripheral devices according a first embodiment of a starter control apparatus.
Figure 9:
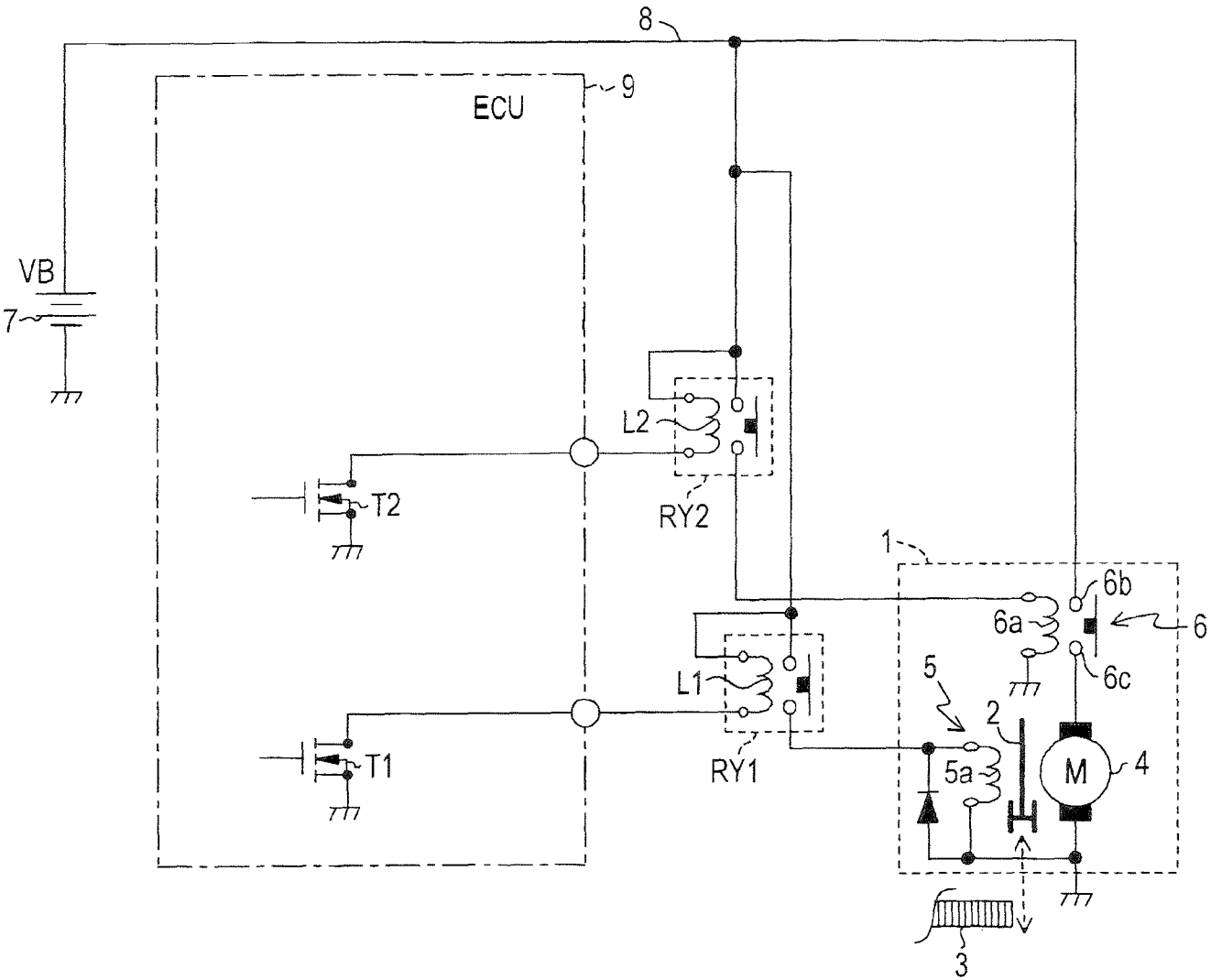
FIG. 9 PRIOR ART
FIG. 9 is a circuit diagram showing a background art of a conventional starter control apparatus.

Referring first to FIG. 1 showing an ECU 11, the same parts as those shown in FIG. 9 are designated by the same reference numerals used in FIG. 9 so that the detailed description for such same parts is omitted. The ECU 11 is configured to not only control an independently-controlled starter 1 for starting an internal combustion engine (not shown) of a vehicle but also perform idle-stop control, which automatically stops and restarts the engine. It is assumed here that a transmission of the vehicle is a manually-operated one (a manual transmission).

The ECU 11 receives a starter signal, a brake signal, an accelerator signal, a clutch signal, a shift position signal, a vehicle speed signal, a brake vacuum signal, a rotation signal and the like. The starter signal is changed to an active level when a driver of the vehicle performs a manual starting operation (for example, turning a key inserted into a key cylinder to a start position or pressing a start button). The brake signal is generated by a sensor, which detects pressing-down of a brake pedal. The accelerator signal is generated by a sensor, which detects pressing-down of an accelerator pedal. The clutch signal is generated by a sensor, which detects pressing-down of a clutch pedal. The shift position signal is generated by a sensor, which detects a manipulation position (shift position) of a shift lever. The vehicle speed signal is generated by a sensor, which detects a travel speed (vehicle speed) of the vehicle. The brake vacuum signal is generated by a sensor, which detects a brake vacuum (vacuum pressure of a brake booster device). The rotation signal is generated by a crankshaft sensor or a camshaft sensor. A battery voltage VB (about 12V), which is an output voltage of a vehicle-mounted battery (corresponding to a power source) 7 is inputted to a battery voltage monitor terminal 12 of the ECU 11. In case that the battery voltage VB is supplied to an ignition system power supply line in the vehicle (that is, ignition-on state), the ECU 11 operates with electric power of the ignition system power supply line.

As described with reference to FIG. 9, the starter 1 has the pinion gear 2, the starter motor 4 for driving the pinion gear 2 to rotate, the pinion control solenoid 5 which is an actuator for driving the pinion gear 2 for engagement with the ring gear 3 of the engine, and the power supply relay 6 for supplying current to the motor 4.

The pinion control solenoid 5 also includes a biasing member (not shown) such as a spring in addition to the coil 5*a*. When the coil 5*a* is not supplied with current, that is, not energized by the battery 7, the pinion gear 2 is biased by force of the biasing member to an initial position (position shown in FIG. 1) not to be engaged with the ring gear 3. When the coil 5*a* is supplied with current, that is, energized by the battery 7, the pinion gear 2 is pushed in the outward direction as shown by an arrow in a dotted line in FIG. 1 to engage with the ring gear 3 by the electromagnetic force generated by the power supply. When the motor 4 is supplied with current under a state that the pinion gear 2 is being engaged with the ring gear 3, rotation force of the motor 4 is transferred to the ring gear 3 through the pinion gear 2 and the engine is cranked.

In the vehicle, the pinion drive relay RY1 and the motor drive relay RY2 are provided outside the ECU 11 in electrically parallel relation to each other between the power supply line 8 and the ground. The pinion drive relay RY1 is for supplying a current to the coil 5*a* of the pinion control solenoid 5. The relay RY2 is for supplying a current to the coil 6*a* of the power supply relay 6.

The downstream side (negative or low potential side opposite to the side of supply of battery voltage VB) of the coil L1 of the pinion drive relay RY1 is connected to a terminal J1 of the ECU 11 to form a part of a first current path CP1. The terminal J1 is connected to an output terminal, which is different from that connected to the ground line, among output terminals of the transistor T1 provided in the ECU 11. The transistor T1 is a N-channel MOSFET. A source of the transistor t1 is connected to the ground line, and a drain of the transistor T1 is hence connected to the terminal J1.

Similarly, the downstream side of the coil L2 of the motor drive relay RY2 is connected to a terminal J2 of the ECU 11 to form a part of a second current path CP2. The terminal J2 is connected to an output terminal, which is different from that connected to the ground line, among output terminals of the transistor T2 provided in the ECU 11. The transistor T2 is also a N-channel MOSFET. A source of the transistor T2 is connected to the ground line, and a drain of the transistor T2 is hence connected to the terminal J2.

Differently from the control circuit 9 shown in FIG. 9, the ECU 11 includes a transistor T3 so that the battery voltage VB is supplied to the upstream side of the coils L1 and L2 of the relays RY1 and RY2 through the transistor T3.

More specifically, the transistor T3 is a P-channel MOSFET. A source of the transistor T3 is connected to the line of the battery voltage VB in the ECU 11. A drain of the transistor T3 is connected to a terminal J3 of the ECU 11. Outside the ECU 11, one ends (upstream or positive side ends) of the coils L1 and L2 of the relays RY1 and RY2 are connected to each other, and an in-vehicle wiring line extending from a junction Pc of the upstream side ends of the coils L1 and L2 is connected to the terminal J3 of the ECU 11 as a part of a third current path CP3.

With this circuit configuration, when the transistor T3 is turned on, the battery voltage VB is supplied to the upstream sides of the coils L1 and L2 from the terminal J3 of the ECU 11. When the transistors T1 and T2 are turned on under this state, current flows to the coils L1 and L2 to turn on the relays RY1 and RY2 so that the starter 1 functions to crank the engine.

The ECU 11 includes a microcomputer 13, an input circuit 15, two resistors 17 and 18, and a capacitor 19. The microcomputer 13 is provided to perform various processing for controlling the idle-stop operation and the starter 1. The input circuit 15 is provided to input various signals such as the starter signal. The resistors 17 and 18 are provided to divide the battery voltage VB inputted from the battery voltage monitor terminal 12 into a voltage, which is in a range of a voltage value suitable for being inputted. The capacitor 19 is provided between a voltage line at a junction between the resistors 17, 18 and the ground line to remove noise. The microcomputer 13 A/D-converts the voltage developed at the junction between the resistors 17 and 18 by its internal A/D converter (not shown) to detect the battery voltage VB. The microcomputer 13 also detects voltage values of analog signals among signals inputted from the input circuit 15 by A/D conversion of the internal A/D converter. The microcomputer 13 controls the operation of the starter 1 by driving the transistors T1 to T3.

The ECU 11 further includes a first pull-down resistor R1, a second pull-down resistor R2, a pull-up resistor R3, a first voltage monitor circuit M1, a second voltage monitor circuit M2 and a third voltage monitor circuit M3 to detect abnormality of a power supply circuit (referred to as a power supply circuit for the coils L1 and L2), which supplies currents to the coils L1 and L2. The pull-down resistor R1 is connected between the ground line and the terminal J1 connected to the downstream side of the coil L1. The pull-down resistor R2 is connected between the ground line and the terminal J2, to which the downstream side of the coil L2 is connected. The pull-up resistor R3 is connected between the line of the battery voltage VB and the terminal J3, at which the upstream sides of the coils L1 and L2 are connected to each other. The voltage monitor circuit M1 is provided to monitor a first voltage V1 developed at an end (positive side) opposite to the ground line side of the pull-down resistor R1. The voltage monitor circuit M2 is provided to monitor a second voltage V2 developed at an end (positive side) opposite to the ground line side of the pull-down resistor R2. The voltage monitor circuit M3 is provided to monitor a third voltage V3 developed at an end (positive side) opposite to the battery voltage VB side of the pull-down resistor R3. In the following description, the first to the third voltages V1 to V3 (also voltages at terminals J1 to J3), which are developed by the pull-down resistors R1 to R3 and monitored by the voltage monitor circuits M1 to M3 are also referred to as first to third monitor voltages V1 to V3, respectively.

The first voltage monitor circuit M1 includes a first comparator 21, two first resistors 31, 32, and a first pull-up resistor 24. The comparator 21 is connected to the terminal 31 at its non-inverting input terminal (+ terminal). The resistors 31 and 32 divide the battery voltage VB and input a first divided voltage to an inverting input terminal (− terminal) of the comparator 21 as a first threshold voltage Vth1. The pull-up resistor 24 is connected between a line of a constant voltage VD (5V, for example) generated inside the ECU 11 and an output terminal of the comparator 21.

Similarly, the voltage monitor circuit M2 includes a second comparator 22, two second resistors 33, 34, and a second pull-up resistor 25. The comparator 22 is connected to the terminal J2 at its non-inverting input terminal. The resistors 33 and 34 divide the battery voltage VB and input a second divided voltage to an inverting input terminal of the comparator 22 as a second threshold voltage Vth2. The pull-up resistor 25 is connected between the line of the constant voltage VD (5V) and an output terminal of the comparator 22.

The voltage monitor circuit M3 includes a third comparator 23, two third resistors 35, 36, and a third pull-up resistor 26. The comparator 23 is connected to the terminal 33 at its non-inverting input terminal. The resistors 35 and 36 divide the battery voltage VB and input a third divided voltage to an inverting input terminal of the comparator 23 as a third threshold voltage Vth3. The pull-up resistor 26 is connected between the line of the constant voltage VD (5V) and an output terminal of the comparator 23.

Respective first to third outputs CM1, CM2 and CM3 of the comparators 21, 22 and 23 are inputted to the microcomputer 13. Output circuits inside the comparators 21 to 23 are current draw (open collector or open drain) type. The pull-up resistors 24 to 26 are provided so that the comparators 21 to 23 can output signal of high level (5V).

Resistance values r1, r2, and r3 of the pull-down resistor R1, the pull-down resistor R2 and the pull-up resistor R3 are determined to satisfy a relation, that is, r1=r2=2×r3. The resistance values r1, r2 and r3 are determined to be sufficiently greater than resistance values of the coils L1 and L2 of the relays RY1 and RY2 so that the relays RY1 and RY2 are not turned on when the transistors T1 to T3 are turned off.

That is, even when the transistors T1 to T3 are turned off, two current paths are formed. One current path (first current path CP1) is from the line of the battery voltage VB to the ground line through the pull-up resistor R3, the coil L1, the pull-down resistor R1. The other current path (second current path CP2) is from the line of the battery voltage VB to the ground line through the pull-up resistor R3, the coil L2 and the pull-down resistor R2. Therefore, the resistance values r1 to r3 of the pull-down resistors R1 to r3 are set to sufficiently large values so that the currents flowing in the current paths CP1 and CP2 are less than coil currents, which are capable of turning on the relays RY1 and RY2. The resistance values of the coils L1 and L2 are about 100Ω and hence the resistance values are set to be about 100 times as large. For example, the resistance values are set as r1=r2=20KΩ and r3=10KΩ.

Figure 2:
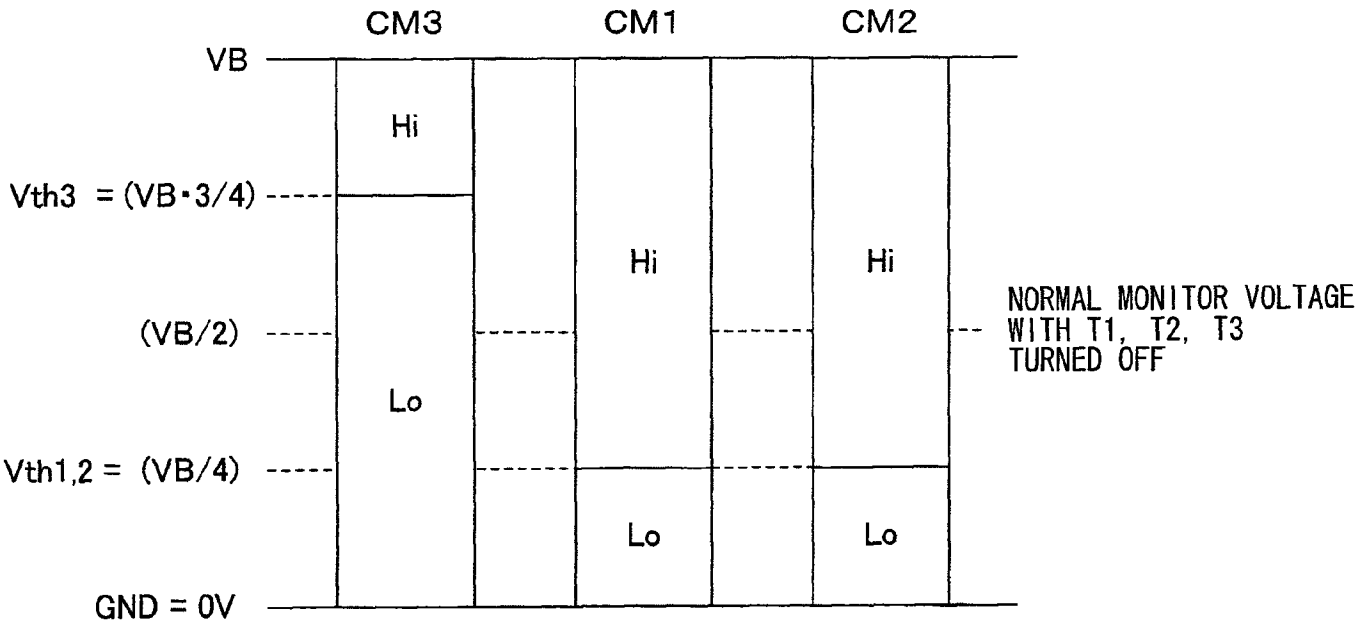
FIG. 2 is an explanatory chart showing a relation between threshold voltages and a power source voltage in the first embodiment.

The resistance values of the coils L1 and L2 are thus negligible relative to the resistance values r1 to r3. When the three transistors T1 to T3 are being turned off, the monitor voltages V1, V2 and V3 correspond as shown in FIG. 2 to a voltage, which is determined by dividing as a function of r3 and r1//r2. It becomes therefore a half voltage (VB/2) of the battery voltage VB.

The resistance values of the resistors 31 and 32 in the voltage monitor circuit M1 are set to a ratio of 3:1 so that the first threshold value Vth1 inputted to the comparator 21 becomes a quarter voltage (VB/4) of the battery voltage VB as shown in FIG. 2. The resistance values of the resistors 33 and 34 in the voltage monitor circuit M2 are set to a ratio of 3:1 so that the second threshold value Vth2 inputted to the comparator 22 becomes a quarter voltage (VB/4) of the battery voltage VB as shown in FIG. 2. The resistance values of the resistors 35 and 36 in the voltage monitor circuit M3 are set to a ratio of 1:3 so that the third threshold value Vth3 inputted to the comparator 23 becomes a three quarter voltage (3×VB/4) of the battery voltage VB as shown in FIG. 2.

The microcomputer 13 detects abnormality in the power supply circuit for the coils L1 and L2 based on a relation of correspondence between driven states of the transistors T1 to T3 and the outputs CM1 to CM3 of the comparators 21 to 23. Details of the processing for detecting abnormality will be described later.

Figure 3:
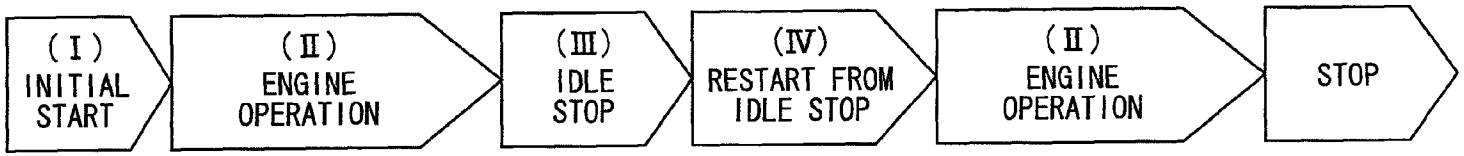
FIG. 3 is a time chart showing engine states in sequence in the first embodiment.

Details of control processing, which the microcomputer 13 performs, will be described with reference to FIG. 3. FIG. 3 shows engine states in time sequence. When a driver of the vehicle perform a starting operation and the starter signal changes to an active level (high), the microcomputer 13 drives the starter 1 to crank the engine. This forms an initial start state (I) in FIG. 3.

As detailed processing, before the state (I), the transistors T1 to T3 are in the off-state. In the state (I) the microcomputer 13 turns on the transistor T3 to supply the battery voltage VB to the upstream sides of the coils L1 and L2 of the relays RY1 and RY2 through the transistor T3 when the engine is to be started by the starter 1. By turning on the transistor T1, the pinion drive relay RY1 is turned on to supply the coil 5*a* of the pinion control solenoid 5 with the current and engage the pinion gear 2 with the ring gear 3. By further turning on the transistor T2 by the microcomputer 13, relay RY2 is turned on to supply the coil 6*a* of the power supply relay 6 with the current and turn on the relay 6.

The current flows from the battery 7 to the motor 4, and the motor 4 operates (rotates). With the rotating force of the motor 4, the pinion gear 2 rotates the ring gear 3 to crank the engine.

When the engine is thus cranked, other ECU performs fuel injection and spark ignition for the engine. If the engine is a diesel engine, no spark ignition is performed and only fuel injection is performed. It is possible to configure the system so that the ECU 11 controls the engine as well.

After determining that the engine has attained complete combustion (starting has been completed and the engine has been successfully started), the microcomputer 13 turns off the three transistors T1 to T3 to stop the current supply to the motor 4 and returns the pinion gear 2 to the initial position, at which the pinion gear 2 is disengaged from the ring gear 3 and not engaged with the ring gear 3 any more. The microcomputer 13 calculates an engine rotation speed from the rotation signal and checks whether the engine has attained the complete combustion based on the engine rotation speed.

The starter control processing (control processing for the starter 1) is performed as described above. When the engine is in operation, it is referred to as an engine operation state (II) in FIG. 3. During the engine is in operation, the microcomputer 13 checks whether a predetermined automatic stop condition is satisfied. If satisfied, the microcomputer 13 automatically stops the engine by cutting off fuel injection to the engine or interrupting an intake air supply to the engine. When the engine is thus automatically stopped, it is referred to as an idle-stop state (III) in FIG. 3.

The predetermined automatic stop condition is defined to satisfying all of the following conditions:

the battery voltage VB is equal to or higher than a predetermined value;

the travel speed is lower than a predetermined value;

the absolute value of the brake vacuum pressure is equal to or less than a predetermined value;

the brake pedal is depressed;

the shift position is at the neutral position, or the shift position is other than the neutral position and a clutch pedal is depresses;

accelerator pedal is not depressed; and more than a predetermined fixed time has elapsed after restarting the engine following a previous automatic stop operation of the engine.

During the idle-stop state, when it is determined that the predetermined automatic start condition is met, the starter control processing is performed for restarting the engine. This state is referred to as a restart state (IV) in FIG. 3.

As the predetermined automatic restart condition, for example, any one of the following condition is defined;

the brake pedal is released from the depressed state when the engine is stopped as the idle-stop under a state that the shift position is other than the neutral position and the clutch pedal is being depressed;

the clutch pedal release (operation to reduce depression of the clutch pedal to connect the clutch) is started under a state that the shift position is other than the neutral position, while the brake pedal is being depressed; or the shift position is change from the neutral position to a position other than the neutral position (the clutch pedal is being depressed), while the brake pedal is being depressed.

Stop at the right end in FIG. 3 indicates that the engine is stopped by the engine stopping operation of a driver, which is different from the idle-stop state (III). In this instance, the ignition system power supply in a vehicle is also turned off.

The microcomputer 13 performs abnormality detection processing for detecting an abnormality in the power supply circuit for the coils L1 and L2 during the operation state of the engine (state (II) in FIG. 3). This abnormality detection processing may be performed, for example, immediately after completion of the initial starting of the engine (I) or periodically in the engine operation state (II). It is also possible to perform the abnormality detection processing in the idle-stop of the engine (state (3) in FIG. 3). That is, the abnormality detection processing is performed when the starter 1 is not operated to start the engine.

The abnormality detection processing performed for the power supply circuit of the coils L1 and 12 will be described next. It is noted that the outputs CM1, CM2 and CM3 of the comparators 21, 22 and 23 are referred to only as CM1, CM2 and CM3 in some cases in the following description. It is further assumed that the resistances of the coils L1 and L2 are ignored (0Ω) in the following description.

Abnormality detection principle will be described first with reference to FIG. 4. If the power supply circuit for the coils L1 and L2 are normal, the monitor voltages V1, V2 and V3 are VB/2 when the three transistors T1 to T3 are in the off-state. In this case, as shown in the column of "normal" in the row of "check drive mode (1)" in FIG. 4, CM3 becomes low (Lo) and CM1 and CM2 become high (Hi). This is because VB/2 is lower than the third threshold voltage Vth3 of the comparator 23 and higher than the first threshold voltage Vth1 and the second threshold voltage Vth2 of the comparators 21 and 22 (refer to FIG. 2).

With respect to this situation, it is assumed that any one of the following abnormalities arose and is present.

(a) Continuation of connection of the downstream side of the coil L1 of the pinion drive relay RY1 to the ground line. More specifically, this abnormality arises from the on-failure (continuation of on-state and failure to turn off) of the transistor T1 or the ground short of the downstream side current path of the first coil, which is between the coil L1 and the transistor T1.

(b) Continuation of connection of the downstream side of the coil L2 of the motor drive relay RY2 to the ground line. More specifically, this abnormality arises from the on-failure of the transistor 12 or the ground short of the downstream side current path of the second coil, which is between the coil L2 and the transistor T2.

(c) Ground short of the coil upstream side path, which is a current path to the junction Pc of the upstream side ends of the transistor T3 and coils L1, L2. When any one of the above abnormalities (a) to (c) arises, the monitor voltages V1 to V3, which are generated when the three transistors T1 to T3 are being turned off, become lower (about 0V) than VB/2 of the normal time and are lower than the first threshold voltage Vth1 and the second threshold voltage Vth2.

As a result, when any one of the abnormalities (a) to (c) arises, all of CM1, CM2 and CM3 become low as indicated in each column (a), (b) and (c) in the row of "check drive mode (1)" in FIG. 4.

It is further assumed that any one of the following abnormalities (d), (e) and (f) arises.

(d) Power supply short of the downstream side path of the first coil (short to the battery voltage VB).

(e) Power supply short of the downstream side path of the second coil.

(f) Continuation of the power source voltage to the coil upstream side path.

More specifically, this abnormality arises from the power supply short of the coil upstream side path or the on-failure of the transistor T3.

When any one of the above abnormalities (d) to (f) arises, the monitor voltages V1 to V3, which are generated when the three transistors T1 to T3 are being turned off, become higher (battery voltage VB) than VB/2 of the normal time and are higher than the third threshold voltage Vth3. As a result, when any one of the abnormalities (d) to (f) arises, all of CM1, CM2 and CM3 become high as indicated in each column (d), (e) and (f) in the row of "check drive mode (1)" in FIG. 4.

It is further assumed that the following abnormality (g) arises.

(g) Wire break at the more downstream side than the junction with the pull-up resistor R3 in the coil upstream side path (that is, current path from the end of the pull-up resistor R3 opposite to the battery voltage VB side to the junction Pc of the upstream side ends of the coils L1 and L2, practically the in-vehicle wiring connecting the terminal J3 of the ECU 11 and the junction Pc).

When the above abnormality (g) arises, the monitor voltage V3 (battery voltage VB), which is generated when the three transistors T1 to T3 are being turned off, becomes higher (0V) than the third threshold voltage Vth3 by the operation of the pull-up resistor R3. The monitor voltages V1 and V2 become lower than the voltage V1 and the voltage V2 by the operation of the pull-down resistors R1 and R2, respectively. As a result, when the abnormality (g) arises, CM3 becomes high and CM1, CM2 become low as indicated in the column (g) in the row of the check drive mode (1) in FIG. 4.

It is further assumed that the following abnormality (h) arises.

(h) Wire break at the more upstream side than the junction with the pull-down resistor R1 in the first coil downstream side path (that is, current path from the end of the pull-down resistor R1 opposite to the ground line side to the downstream side end of the coil L1, practically the in-vehicle wiring connecting the terminal J1 of the ECU 11 and the coil L1).

When the above abnormality (h) arises, the monitor voltage V1, which is generated when the three transistors T1 to T3 are being turned off, becomes lower (0V) than the first threshold voltage Vth1 by the operation of the pull-down resistor R3. The monitor voltages V2 and V3 become the divided voltage (=2×VB/3) produced by dividing the battery voltage VB by the resistors R3 (r3=10KΩ) and the pull-down resistor R2 (r2=20KΩ) and are higher than VB/2. The monitor voltages V2 and V3 are higher than the second threshold voltage Vth2 but lower than the third threshold voltage Vth3. As a result, when the abnormality (h) arises, CM2 becomes high and CM1, CM3 become low as indicated in the column (h) in the row of the check drive mode (1) in FIG. 4.

It is further assumed that the following abnormality (i) arises.

(i) Wire break at the more upstream side than the junction with the pull-down resistor R2 in the second coil downstream side path (that is, current path from the end of the pull-down resistor R2 opposite to the ground line side to the downstream side end of the coil L2, practically the in-vehicle wiring connecting the terminal 32 of the ECU 11 and the coil L2).

When the above abnormality (i) arises, the monitor voltage V2, which is generated when the three transistors T1 to T3 are being turned off, becomes lower (0V) than the second threshold voltage Vth2 by the operation of the pull-down resistor R2. The monitor voltages V1 and V3 become the divided voltage (=2×VB/3) produced by dividing the battery voltage VB by the resistors R3 (r3=10KΩ) and the pull-down resistor R1 (r1=20K) and are higher than VB/2. The monitor voltages V1 and V3 are higher than the first threshold voltage Vth1 but lower than the third threshold voltage Vth3. As a result, when the abnormality (i) arises, CM1 becomes high and CM2, CM3 become low as indicated in the column (i) in the row of the check drive mode (1) in FIG. 4.

As described above, the microcomputer 13 detects any one of the abnormalities (a) to (i) based on combinations of CM1 to CM3 under the condition that the transistors T1 to T3 are being turned off. That is, it is possible to determine that any one of the abnormalities (a) to (i) is present other than the combination that the CM3 is low and CM1, CM2 are high.

Further, as classified in the bottom row in FIG. 4, the abnormalities (d) to (f) are classified as abnormality [1], the abnormalities (a) to (c) as abnormality [2], the abnormality (g) as abnormality [3], the abnormality (h) as abnormality [4], and the abnormality (i) as abnormality [5]. According to this classification, the combinations of CM1 to CM3, which are produced when the three transistors T1 to T3 are being turned off, differ among the classified abnormalities [1] to [5]. The microcomputer 13 thus specifies (identifies) which one of the abnormalities [1] to [5] is present by checking the combinations of CM1 to CM3.

It is assumed further that the following abnormality (j) to (l) arises.

(j) Off-failure (continuation of off-state and failure to turn on) of the transistor T1

(k) Off-failure of the transistor T2

(l) Off-failure of the transistor T3

When any one of the above abnormalities (j) to (l) arises, the monitor voltages V1 to V3, which are produced when the transistors T1 to T3 are being turned off, become VB/2, which is the same as the normal time. That is, since the transistors T1 to T3 are being turned off, no indication of the off-failure arises. When the three transistors T1 to T3 are being turned off, CM1 to CM3 become the same output value as that of the normal time even if any one of the abnormalities (j) to (l) is present. As a result, as indicated in the columns (j), (k) and (l) in the row of the check drive mode (1) in FIG. 4, CM3 is low and CM1, CM2 are high.

If only the transistor T1 among the three transistors T1 to T3 is turned on, the monitor voltages V1 to V3 become lower (about 0V) than the first voltage Vth1 and the second threshold voltage Vth2 if normal. As a result, as indicated in the column "normal" in the row of the check drive mode (2) in FIG. 4, all of CM1 to CM3 become low.

If the transistor T1 has the off-failure, however, the transistor T1 does not turn on actually when only the transistor T1 among the three transistors T1 to T3 is turned on. In the similar manner as the three transistors T1 to T3 are turned off, the monitor voltages V1 to V3 become VB/2. As a result, CM3 is low and CM1, CM2 are high as indicated in the column (j) in the row of the check drive mode (2) in FIG. 4. The microcomputer 13 thus detects the off-failure (that is, abnormality [j]) of the transistor T1 based on CM1 to CM3 produced when only the transistor T1 is turned on.

Similarly, if only the transistor T2 among the three transistors T1 to T3 is turned on, the monitor voltages V1 to V3 become lower (about 0V) than the first threshold voltage Vth1 and the second threshold voltage Vth2 if normal. As a result, as indicated in the column "normal" in the row of the check drive mode (3) in FIG. 4, all of CM1 to CM3 become low.

If the transistor T2 has the off-failure, however, the transistor T2 does not turn on actually when only the transistor T2 among the three transistors T1 to T3 is turned on. In the similar manner as the three transistors T1 to T3 are turned off, the monitor voltages V1 to V3 become VB/2. As a result, CM3 is low and CM1, CM2 are high as indicated in the column (k) in the row of the check drive mode (3) in FIG. 4. The microcomputer 13 thus detects the off-failure (that is, abnormality [k]) of the transistor T2 based on CM1 to CM3 produced when only the transistor T2 is turned on.

Further, if only the transistor T3 among the three transistors T1 to T3 is turned on, the monitor voltages V1 to V3 become higher (about the battery voltage VB) than the third threshold voltage Vth3 if normal. As a result, as indicated in the column "normal" in the row of the check drive mode (4) in FIG. 4, all of CM1 to CM3 become high.

If the transistor T3 has the off-failure, however, the transistor T3 does not turn on actually when only the transistor T3 among the three transistors T1 to T3 is turned on. In the similar manner as the three transistors T1 to T3 are turned off, the monitor voltages V1 to V3 become VB/2. As a result, CM3 is low and CM1, CM2 are high as indicated in the column (l) in the row of the check drive mode (4) in FIG. 4. The microcomputer 13 thus detects the off-failure (that is, abnormality [l]) of the transistor T3 based on CM1 to CM3 produced when only the transistor T3 is turned on.

Although no detailed description will be made, if only the transistor T1 among the three transistors T1 to T3 is turned on, CM1 to CM3 take the logic levels indicated in the columns (a) to (i), (k) and (l) in the row of the check drive mode (2) in FIG. 4 if the above abnormality (a) to (i), (k) or (l) is present. If only the transistor T2 among the three transistors T1 to T3 is turned on, CM1 to CM3 take the logic levels indicated in the columns (a) to (j) and (l) in the row of the check drive mode (3) in FIG. 4 if the above abnormality (a) to (j) or (l) is present. If only the transistor T3 among the three transistors T1 to T3 is turned on, CM1 to CM3 take the logic levels indicated in the columns (a) to (k) in the row of the check drive mode (4) in FIG. 4 if the above abnormality (a) to (k) is present.

In case of the combination, which is highlighted in FIG. 4 by slash line hatching, among the combinations of the check drive modes of the transistors T1 to T3 and the abnormality contents, the transistor, which is driven to turn on by the drive signal from the microcomputer 13, is turned off forcibly by the over-current protection function provided therein. That is, if the abnormality (d) is present when the transistor T1 is turned on, the transistor turns off by its over-current protection function irrespective of the drive signal from the microcomputer 13. If the abnormality (e) is present when the transistor T2 is turned on, the transistor T2 turns off by its over-current protection function irrespective of the drive signal from the microcomputer 13. If the abnormality (c) is present when the transistor T3 is turned on, the transistor T3 turns off by its over-current protection function irrespective of the drive signal from the microcomputer 13.

The abnormalities are detected based on the above-described principles. Fail-safe processing, which is performed by the microcomputer 13 upon detection of abnormality, will be described next with reference to FIG. 5. In the following description, in addition to the above-described classification of abnormalities [1] to [5], abnormalities [6] to [8] are added.

That is, the abnormality (l) (off-failure of the transistor T3), the abnormality (j) (off-failure of the transistor T1) and the abnormality (k) (off-failure of the transistor T2) are classified as the abnormalities [6], [7] and [8], respectively.

Figure 6:
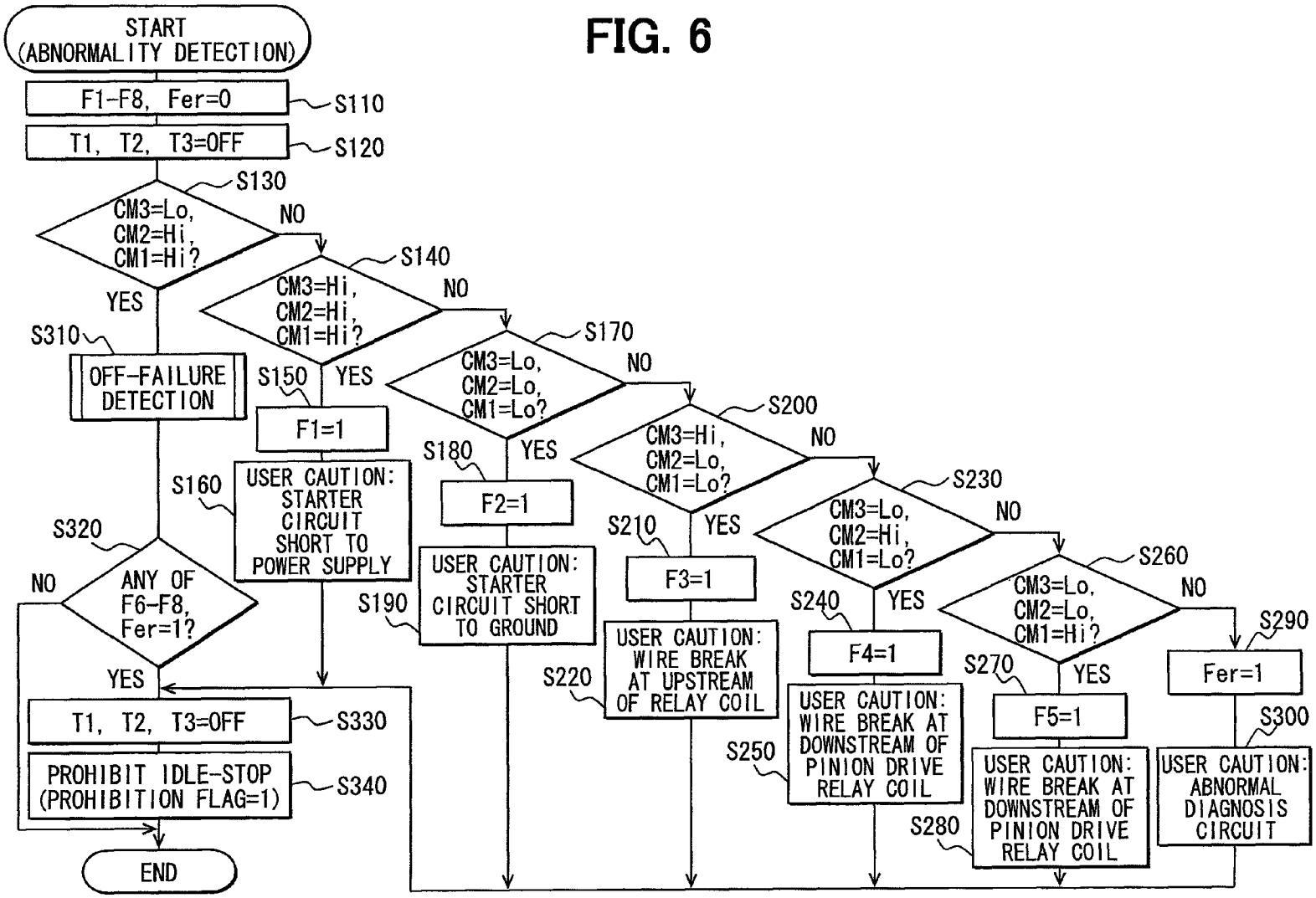
FIG. 6 is a flowchart showing abnormality detection processing in the first embodiment.

As shown in FIG. 6, the microcomputer 13 performs processing of providing a user of the vehicle with a warning, which indicates that the starter circuit is shorted to the power supply source, as processing of a user caution (warning to the user of the vehicle), when the abnormality [1] (abnormalities (d) to (f)) is detected. Further the microcomputer 13 stores the abnormality information indicating the presence of the abnormality [1] in a non-volatile memory or the like (not shown in FIG. 5) and performs processing of prohibition of the idle-stop (automatic stop of the engine).

The processing provided to the user of the vehicle may include processing of displaying a message indicating the content of the warning on a display or outputting the message from a speaker, processing of activating a warning light provided to indicate the content of the warning and the like.

As the processing of prohibiting the idle-stop, an idle-stop prohibition flag may be set (to 1). That is, when the idle-stop prohibition flag is set to 1, the microcomputer 13 does not check whether the automatic stop condition is satisfied during the engine operation or does not perform the processing of stopping the engine even if the automatic stop condition is determined to be satisfied.

The idle-stop is prohibited when the abnormality [1] is detected for the following reason. Among the abnormality [1], it is possible to control the starter 1 by turning the transistors T1 and T2 on/off in case of the abnormality (f). If the abnormality (a) or (b) arises further, the current path to the coils L1 and L2 cannot be interrupted by the transistor T3. In addition, it is not possible to determine whether the abnormality is the abnormality (f) or the abnormality (d), (e). If it is the abnormality (d) or (e), the relays RY1 and RY2 cannot be driven and hence the starter 1 cannot be operated. Further, in case of the abnormality (d) or (e), if the transistors T1 and T2 have no over-current protection functions therein, the transistors T1 and T2 are likely to be broken by the over-currents when the transistors T1 and T2 are turned on at the time of engine restarting from the idle-stop state.

In case of detection of the abnormality [1], it is likely that the starter 1 cannot be operated normally. If the engine is stopped automatically by the idle-stop control, it is likely that the engine cannot be restarted thereafter and the vehicle cannot travel on a travel road. It is therefore prevented by prohibiting the idle-stop that the vehicle becomes disabled to travel a road.

The microcomputer 13 detects the abnormality [1] under the state that the three transistors T1 to T3 are being turned off. However, it does not perform the processing of detecting an abnormality (that is, processing for detecting the off-failure of the transistors T1 to T3) by turning on one of the transistors T1 to T3.

This is because that a correct detection result cannot be acquired in respect of detection of the off-failure of the transistor (that is, even if any one of the transistors T1 to T3 has the off-failure, the combination that the CM3 is low and CM1, CM2 are high cannot be provided when the processing for detecting the off-failure of the transistors T1 to T3 are performed. Further if it is the abnormality (f) that is present, the relays RY1 and RY2 are turned on unnecessarily when the transistor T1 or the transistor T2 is turned on. As a result, even though it is not the engine start time, the pinion gear 2 or the motor 4 is driven to operate. Driving the pinion 2 to operate means that the pinion gear 2 is engaged with the ring gear 3. Further even if it is the abnormality (d) or (e) that is present, it is not desired because the transistor T1 or the transistor T2 is turned on while being shorted to the power supply source.

The microcomputer 13 performs processing of providing the user of the vehicle with a warning, which indicates that the starter circuit is shorted to the ground, as processing of a user caution, when the abnormality [2] (abnormalities (a) to (c)) is detected. Further the microcomputer 13 stores the abnormality information indicating the presence of the abnormality [2] in the non-volatile memory or the like (not shown in FIG. 5) and performs processing of prohibition of the idle-stop.

The idle-stop is prohibited when the abnormality [2] is detected for the following reason. Among the abnormality [2], it is possible to control the starter 1 by turning the transistor T3 on/off in case of the abnormality (a) or (b). However, at the time of engine starting, the drive operation sequence must be controlled such that the pinion gear 2 is driven first and the motor 4 is driven next. In addition, if it is not possible to determine whether the abnormality is the abnormality (a) or the abnormality (b) and the abnormality, which is actually present, is the abnormality (b), the above-described drive sequence control cannot be performed. If it is the abnormality (c) in fact, the relays RY1 and RY2 do not turn on and hence the starter 1 cannot be operated.

In case of detection of the abnormality [2], it is likely that the starter 1 cannot be operated to function or controlled normally. The number of times of engine starting is reduced by prohibiting the idle-stop thereby preventing that the vehicle becomes disabled to travel a road.

The microcomputer 13 detects the abnormality [2] under the state that the three transistors T1 to T3 are driven to be turned off. However, it does not perform the processing of detecting an abnormality (that is, processing for detecting the off-failure of the transistors T1 to T3) by turning on one of the transistors T1 to T3 even when the abnormality [2] is detected.

This is because that a correct detection result cannot be acquired in respect of detection of the off-failure of the transistor. Further if it is the abnormality (a) or (b) that is present, the relays RY1 and RY2 are turned on unnecessarily when the transistor T3 is turned on. As a result, even though it is not the engine start time, the pinion gear 2 or the motor 4 is driven to operate. Further even if it is the abnormality (c) that is present, it is not desired because the transistor T3 is turned on while being shorted to the power supply source.

The microcomputer 13 performs processing of providing the user of the vehicle with a warning, which indicates that the upstream side of the relay coils (L1, l2) is broken, as processing of a user caution, when the abnormality [3] (abnormality (g)) is detected. Further the microcomputer 13 stores the abnormality information indicating the presence of the abnormality [3] in the non-volatile memory or the like (not shown in FIG. 5) and performs processing of prohibition of the idle-stop.

Further, the microcomputer 13 performs processing of providing the user of the vehicle with a warning, which indicates that the downstream side of the pinion drive relay coil (L1) is broken, as processing of a user caution, when the abnormality [4] (abnormality (h)) is detected. Further the microcomputer 13 stores the abnormality information indicating the presence of the abnormality [4] in the non-volatile memory or the like (not shown in FIG. 5) and performs processing of prohibition of the idle-stop.

Similarly, the microcomputer 13 performs processing of providing the user of the vehicle with a warning, which indicates that the downstream side of the motor drive relay coil (L2) is broken, as processing of a user caution, when the abnormality [5] (abnormality (i)) is detected. Further the microcomputer 13 stores the abnormality information indicating the presence of the abnormality [5] in the non-volatile memory or the like (not shown in FIG. 5) and performs processing of prohibition of the idle-stop.

The idle-stop is prohibited when any one of the abnormality [3] to the abnormality [5] is detected for the following reason. Since both of or one of the relays RY1 and RY2 do not turn on, the starter 1 cannot be driven to operate and the vehicle is disabled to travel a road.

The microcomputer 13 also detects the abnormalities [3] to [5] under the state that the three transistors T1 to T3 are driven to be turned off. However, it does not perform the processing of detecting an abnormality (that is, processing for detecting the off-failure of the transistors T1 to T3) by turning on one of the transistors T1 to T3, even when any one of the abnormality [3] to abnormality [5] is detected. This is because a correct detection result cannot be acquired in respect of detection of the off-failure of the transistor.

The microcomputer 13 performs processing of providing the user of the vehicle with a warning, which indicates that the transistor (T3) at the upstream of the relay coil has the off-failure, as processing of a user caution, when the abnormality [6] (abnormality (l)) is detected. Further the microcomputer 13 stores the abnormality information indicating the presence of the abnormality [6] in the non-volatile memory or the like (not shown in FIG. 5) and performs processing of prohibition of the idle-stop.

The microcomputer 13 performs processing of providing the user of the vehicle with a warning, which indicates that the drive transistor (T1) of the pinion drive relay has the off-failure, as processing of a user caution, when the abnormality [7] (abnormality (j)) is detected. Further the microcomputer 13 stores the abnormality information indicating the presence of the abnormality [7] in the non-volatile memory or the like (not shown in FIG. 5) and performs processing of prohibition of the idle-stop.

Similarly, the microcomputer 13 performs processing of providing the user of the vehicle with a warning, which indicates that the drive transistor (T2) of the motor drive relay has the off-failure, as processing of a user caution, when the abnormality [8] (abnormality (k)) is detected. Further the microcomputer 13 stores the abnormality information indicating the presence of the abnormality [8] in the non-volatile memory or the like (not shown in FIG. 5) and performs processing of prohibition of the idle-stop.

The idle-stop is prohibited also when any one of the abnormality [6] to the abnormality [8] is detected for the following reason. Since both of or one of the relays RY1 and RY2 do not turn on, the starter 1 cannot be driven to operate and hence the vehicle is disabled to travel a road.

Detailed processing of the abnormality detection processing, which the microcomputer 13 performs, will be described with reference to flowcharts shown in FIG. 6 and FIG. 7. FIG. 6 is a flowchart showing the abnormality detection processing. As described above, the abnormality detection processing is performed, for example, immediately after the completion of the initial starting operation or further periodically during the engine operation.

As shown in FIG. 6, the microcomputer 13, after starting the abnormality detection processing, first resets each flag F1 to F8 and Fer to "0," which indicates OFF, at S110. The flags F1 to F8 are flags, which are set to ON when the abnormality [1] to the abnormality [8] are detected, respectively. The flag Fer is a flag, which is set to ON when a diagnosis circuit (specifically, a circuit formed of the pull-down resistors R1 to R3 and the voltage monitor circuits M1 to M3) for detecting the abnormality [1] to the abnormality [8] is detected to be abnormal.

At next step S120, the transistors T1 to T3 are turned off. That is, the transistors T1 to T3 are driven to turn off by outputting the drive signals for the transistors T1 to T3 in an inactive level, which turns off the transistor. As the control processing for the starter 1, the transistors T1 to T3 are being turned off during the engine operation, that is, when the starter 1 is not driven to operate.

At next S130, the outputs CM1 to CM 3 of the comparators 21 to 23 are acquired and it is checked whether CM3 is low (Lo) and CM1 and CM2 are high (Hi). If the check result does not indicate that CM3 is low and CM1 and CM2 are high, it indicates as described above that any one of the abnormality [1] to the abnormality [5] is present (refer to the row of the check drive mode (1) in FIG. 4). In this case, S140 is executed to specify the abnormality, which is present.

At S140, it is checked whether CM1, CM2 and CM3 are high. If CM1, CM2 and CM3 are high, it is determined that the abnormality [1] is present and S150 is executed. At S150, the flag F1 is set to "1," which indicates ON, thereby to store a history of detection of the abnormality [1]. At S160, as the user caution processing, the warning indicating that the starter circuit is shorted to the power supply is issued to the user of the vehicle. Then S330 is executed.

If the check result at S140 does not indicate that CM1, CM2 and CM3 are high, S170 is executed to check whether CM1, CM2 and CM3 are low. If the check result indicates that CM1, CM2 and CM3 are low, it is determined that the abnormality [2] is present and S180 is executed. At S180, the flag F2 is set to "1," which indicates ON, thereby to store a history of detection of the abnormality [2]. At S190, as the user caution processing, the warning indicating that the starter circuit is shorted to the ground is issued to the user of the vehicle. Then S330 is executed.

If the check result at S170 does not indicate that CM1, CM2 and CM3 are low, S200 is executed to check whether CM3 is high and CM1 and CM2 are low. If the check result indicates that CM3 is high and CM1 and CM2 are low, it is determined that the abnormality [3] is present and S210 is executed. At S210, the flag F3 is set to "1," which indicates ON, thereby to store a history of detection of the abnormality [3]. At S220, as the user caution processing, the warning indicating that the upstream side of the relay coils (L1, L2) is broken is issued to the user of the vehicle. Then S330 is executed.

If the check result at S200 does not indicate that CM3 is high and CM1 and CM2 are low, S230 is executed to check whether CM2 is high and CM1 and CM3 are low. If the check result indicates that CM2 is high and CM1 and CM3 are low, it is determined that the abnormality [4] is present and S240 is executed. At S240, the flag F4 is set to "1," which indicates ON, thereby to store a history of detection of the abnormality [4]. At S250, as the user caution processing, the warning indicating that the downstream side of the pinion drive relay coil (L1) is broken is issued to the user of the vehicle. Then S330 is executed.

If the check result at S230 does not indicate that CM2 is high and CM1 and CM2 are low, S260 is executed to check whether CM1 is high and CM2 and CM3 are low. If the check result indicates that CM1 is high and CM2 and CM3 are low, it is determined that the abnormality [5] is present and S270 is executed. At S270, the flag F5 is set to "1," which indicates ON, thereby to store a history of detection of the abnormality [5]. At S280, as the user caution processing, the warning indicating that the downstream side of the motor drive relay coil (L2) is broken is issued to the user of the vehicle. Then S330 is executed.

If the check result at S260 does not indicate that CM1 is high and CM2 and CM3 are low, it is determined that the diagnosis circuit is abnormal and then S290 is executed. If the check result at S260 does not indicate that CM1 is high and CM2 and CM3 are low, it is determined that the combination of outputs CM1 to CM3 in case of turning off the three transistors T1 to T3 do not correspond to any combinations shown in the row of the check drive mode (1) in FIG. 4. As a result, it is determined that the diagnosis circuit is abnormal.

At S290, the flag Fer is set to "1," which indicates ON, thereby to store a history of detection of the abnormality of the diagnosis circuit. At S300, as the user caution processing, the warning indicating that the diagnosis circuit is abnormal is issued to the user of the vehicle. Then S330 is executed.

If the check result at S130 indicates that CM3 is low and CM1 and CM2 are high, it is likely that the power supply circuit to the coils L1 and L2 is normal or any one of the transistors T1 to T3 has the off-failure (refer to the row of the check drive mode (1) in FIG. 4). To distinguish these two possibilities, S310 is executed so that the off-failure detection processing shown in FIG. 7 is performed.

As shown in FIG. 7, after starting the off-failure detection processing, the microcomputer 13 turns on only the transistor T1 at S410 while turning off the transistors T2 and T3. That is, the drive signals to the transistors T2 and T3 are maintained at the inactive level but the drive signal to the transistor T1 is outputted in the active level, by which the transistor is tuned on. Thus, only the transistor T1 is turned on among the three transistors T1 to T3.

At S420, the outputs CM1 to CM3 of the comparators 21 to 23 are acquired and it is checked whether CM3 is low and CM1 and CM2 are high. If the check result indicates that CM3 is low and the CM1 and CM2 are high, it is determined that the abnormality [7] (that is, off-failure of the transistor T1) is present (refer to the row of the check drive mode (2) in FIG. 4). Then S430 is executed.

At S430, the flag F7 is set to "1," which indicates ON, to store a history of detection of the abnormality [7]. At S440, as the processing of user caution, the warning indicating that the drive transistor T1 for the pinion drive relay RY1 has the off-failure is issued to the user of the vehicle. Then S470 is executed.

If the check result at S420 does not indicate that CM3 is low and CM1 and CM2 are high, S450 is executed to check whether CM1 is high and CM2 and CM3 are low. If the check result does not indicate that CM1 is high and CM2 and CM3 are low, S460 is executed to check whether CM 2 is low and CM1 and CM3 are high. If the check result does not indicate that CM2 is low and CM1 and CM3 are high, S470 is executed.

In case of turning on only the transistor T1 among the transistors T1 to T3, the combination that CM1 is high and CM2 and CM3 are low, which is checked at S450, and the combination that CM2 is low and CM1 and CM3 are high, which is checked at S460, are never possible (that is, never present in the row of the check drive mode (2) in FIG. 4) as long as the diagnosis circuit is normal.

At S470, the transistors T1 and T3 are turned off and only the transistor T2 is turned on. That is, the drive signals to the transistors T1 and T3 are set at the inactive level but the drive signal to the transistor T2 is set to the active level. Thus, only the transistor T2 is driven to turn on among the three transistors T1 to T3.

At S480, the outputs CM1 to CM3 of the comparators 21 to 23 are acquired and it is checked whether CM3 is low and CM1 and CM2 are high. If the check result indicates that CM3 is low and the CM1 and CM2 are high, it is determined that the abnormality [8] (that is, off-failure of the transistor T2) is present (refer to the row of the check drive mode (3) in FIG. 4). Then S490 is executed.

At S490, the flag F8 is set to "1," which indicates ON, to store a history of detection of the abnormality [8]. At S500, as the processing of user caution, the warning indicating that the drive transistor T2 for the motor drive relay RY2 has the off-failure is issued to the user of the vehicle. Then S470 is executed.

If the check result at S480 does not indicate that CM3 is low and CM1 and CM2 are high, S510 is executed to check whether CM2 is high and CM1 and CM3 are low. If the check result does not indicate that CM2 is high and CM1 and CM3 are low, S520 is executed to check whether CM1 is low and CM2 and CM3 are high. If the check result does not indicate that CM1 is low and CM2 and CM3 are high, S530 is executed.

In case of turning on only the transistor T2 among the transistors T1 to T3, the combination that CM2 is high and CM1 and CM3 are low, which is checked at S510, and the combination that CM1 is low and CM2 and CM3 are high, which is checked at S520, are never possible (that is, never present in the row of the check drive mode (3) in FIG. 4) as long as the diagnosis circuit is normal.

At S530, the transistors T1 and T2 are turned off and only the transistor T3 is turned on. That is, the drive signals to the transistors T1 and T2 are set at the inactive level but the drive signal to the transistor T3 is set to the active level. Thus, only the transistor T3 is driven to turn on among the three transistors T1 to T3.

At S540, the outputs CM1 to CM3 of the comparators 21 to 23 are acquired and it is checked whether CM3 is low and CM1 and CM2 are high. If the check result indicates that CM3 is low and the CM1 and CM2 are high, it is determined that the abnormality [6] (that is, off-failure of the transistor T3) is present (refer to the row of the check drive mode (4) in FIG. 4). Then S550 is executed.

At S550, the flag F6 is set to "1," which indicates ON, to store a history of detection of the abnormality [6]. At S560, as the processing of user caution, the warning indicating that the transistor T3 at the upstream of the relay coils of the pinion drive relay RY1 and the motor drive relay RY1 has the off-failure is issued to the user of the vehicle. Then S610 is executed.

If the check result at S540 does not indicate that CM3 is low and CM1 and CM2 are high, S570 is executed to check whether CM2 is high and CM1 and CM3 are low. If the check result does not indicate that CM2 is high and CM1 and CM3 are low, S580 is executed to check whether CM1 is high and CM2 and CM3 are low. If the check result does not indicate that CM1 is high and CM2 and CM3 are low, S610 is executed.

In case of turning on only the transistor T3 among the transistors T1 to T3, the combination that CM2 is high and CM1 and CM3 are low, which is checked at S570, and the combination that CM1 is high and CM2 and CM3 are low, which is checked at S580, are never possible (that is, never present in the row of the check drive mode (4) in FIG. 4) as long as the diagnosis circuit is normal.

In case that any one of the check results at S450, S460, S510, S520, S570 and S580 is YES (that is, the combination of the logic levels of CM1 to CM3 is never possible), it is determined that abnormality is present in the diagnosis circuit and S590 is executed.

At S590, the flag Fer is set to "1" to store a history of detection of abnormality of the diagnosis circuit. Then at S600, as processing of user caution, a warning indicating that the diagnosis circuit is abnormal is issued to the user of the vehicle and S610 is executed.

At S160, to return to the abnormality detection processing (FIG. 6), the transistors T1 to T3 are turned off similarly to S120 in FIG. 6. Thus, the off-failure detection processing (S310 in FIG. 6 and FIG. 7) is terminated.

Then S320 in FIG. 6 is executed to check whether any one of the flags F6 to F8 and Fer is "1." That is, at S320, it is checked whether any one of S430, S490, S550 and S590 in the off-failure detection processing of FIG. 7 is executed.

If the check result indicates that any one of the flags F6 to F8 and Fer is not "1" (that is, the flags F6 to F8 and Fer are all "0"), it is determined that there is no abnormality (that is, both the power supply circuit for the coils L1, L2 and the diagnosis circuit are normal). Thus, the abnormality detection processing is finished.

If the check result at S320 indicates that any one of the flags F6 to F8 and Fer is "1," S330 is executed. At S330, to return to the state of starting the abnormality detection processing, the transistors T1 to T3 are turned off similarly to S120. Since S330 is executed when any one of the abnormality [1] to the abnormality [8] is present or the abnormality is present in the diagnosis circuit, processing of prohibiting the idle-stop is executed. Specifically, as described above, the idle-stop prohibition flag is set. Thus, the abnormality detection processing is finished.

The idle-stop operation is stopped when any one of the abnormality [1] to the abnormality [8] is detected, for the reasons described above with reference to FIG. 5. The idle-stop operation is also stopped when the abnormality is detected in the diagnosis circuit. This is because, if the diagnosis circuit is not normal, it is not possible to confirm whether the power supply circuit for the coils L1 and L2 is normal and it is likely that the starter 1 cannot be operated.

The microcomputer 13 refers to the flags F1 to F8 and Fer by other processing of storing abnormality information. If there is any flag, which is "1," abnormality information (that is, diagnosis code) indicating a presence of abnormality, which the flag represents, is stored in the non-volatile memory or the like. This abnormality information stored in the non-volatile memory or the like is retrievable by a failure diagnosis device (that is, scan tool), which is connectable to the ECU 11 for communication.

According to the ECU 11 described above, the transistor T3 is not turned on even when the abnormality (abnormality (a)) is present, in which the downstream side of the coil L1 of the pinion drive relay RY1 is continued to be connected to the ground line. As a result, current is prevented from flowing to the coil L1 and hence the pinion drive relay RY1 is prevented from turning on and driving the pinion gear 2 erroneously or unnecessarily. In the similar manner, the transistor T3 is not turned on even when the abnormality (abnormality (b)) is present, in which the downstream side of the coil L2 of the motor drive relay RY2 is continued to be connected to the ground line. As a result, current is prevented from flowing to the coil L2 and hence the motor drive relay RY2 is prevented from turning on and driving the motor 4 erroneously or unnecessarily.

According to the ECU 11, the battery voltage VB is supplied to both of the coils L1 and L2 through one transistor T3. Thus the transistor T3 prevents that the pinion gear 2 is continuously engaged with the ring gear 3 or the motor 4 is continuously driven to rotate in case of abnormality in the power supply circuit (circuit for turning on each of the relays RY1 and RY2) for the coils L1 and L2. As a result, reliability is enhanced with a small number of additional components.

Further, electric wirings are provided to the contacts of the relays RY1 and RY2 to supply currents from the line 8 of the battery voltage VB without flowing them through the transistor T3. As a result, the transistor T3 may be a small power type, which is advantageous in physical size reduction and low cost.

It is possible to detect each abnormality (abnormality [1] to abnormality [8]) of the power supply circuit or the diagnosis circuit and prohibits the idle-stop operation when any one of the abnormalities is detected. As a result it is possible to prevent in advance the vehicle from being disabled to travel on a road (engine is disabled to be started again).

The microcomputer 13 performs the off-failure detection processing shown in FIG. 7, by which the transistors T1 to T3 are turned on one by one to detect the off-failure of the transistors T1 to T3, after confirming that no abnormality other than the off-failure of the transistors T1 to T3 is present (that is, the processing is performed when the check result at S130 in FIG. 6 is YES). As a result, by performing the off-failure detection processing shown in FIG. 7, it is prevented that the pinion gear 2 or the motor 4 is driven unnecessarily or the transistors T1 to T3 are damaged.

According to the first embodiment, the pinion drive relay RY1 forms a first relay, its coil L1 forms a first coil, the motor drive relay RY2 forms a second relay, its coil L2 forms a second coil, the transistor T1 forms a first switching part, the transistor T2 forms a second switching part and the transistor T3 forms a third switching part for operation prevention.

The pull-down resistor R1 forms a first pull-down resistor, the pull-down resistor R2 forms a second pull-down resistor, and the voltage monitor circuits M1 to M3 and the microcomputer 13 forms an abnormality detection part. The microcomputer 13 also forms an idle-stop control part.

The processing of S110 to S300 in FIG. 6 form all switching parts abnormality detection processing, which is performed at the time of turning off all the switching parts. The case of YES-determination at S130 in FIG. 6 forms a case of no detection of abnormality in the all switching parts abnormality detection processing. The processing of S410 to S440 in FIG. 7 form first switching part abnormality detection processing, which is performed at the time of turning on the first switching part. The processing of S470 to S500 in FIG. 7 form second switching part abnormality detection processing, which is performed at the time of turning on the second switching part. The processing of S530 to S560 in FIG. 7 form third abnormality detection processing, which is performed at the time of turning on the third switching part.

Second Embodiment

Figure 8:
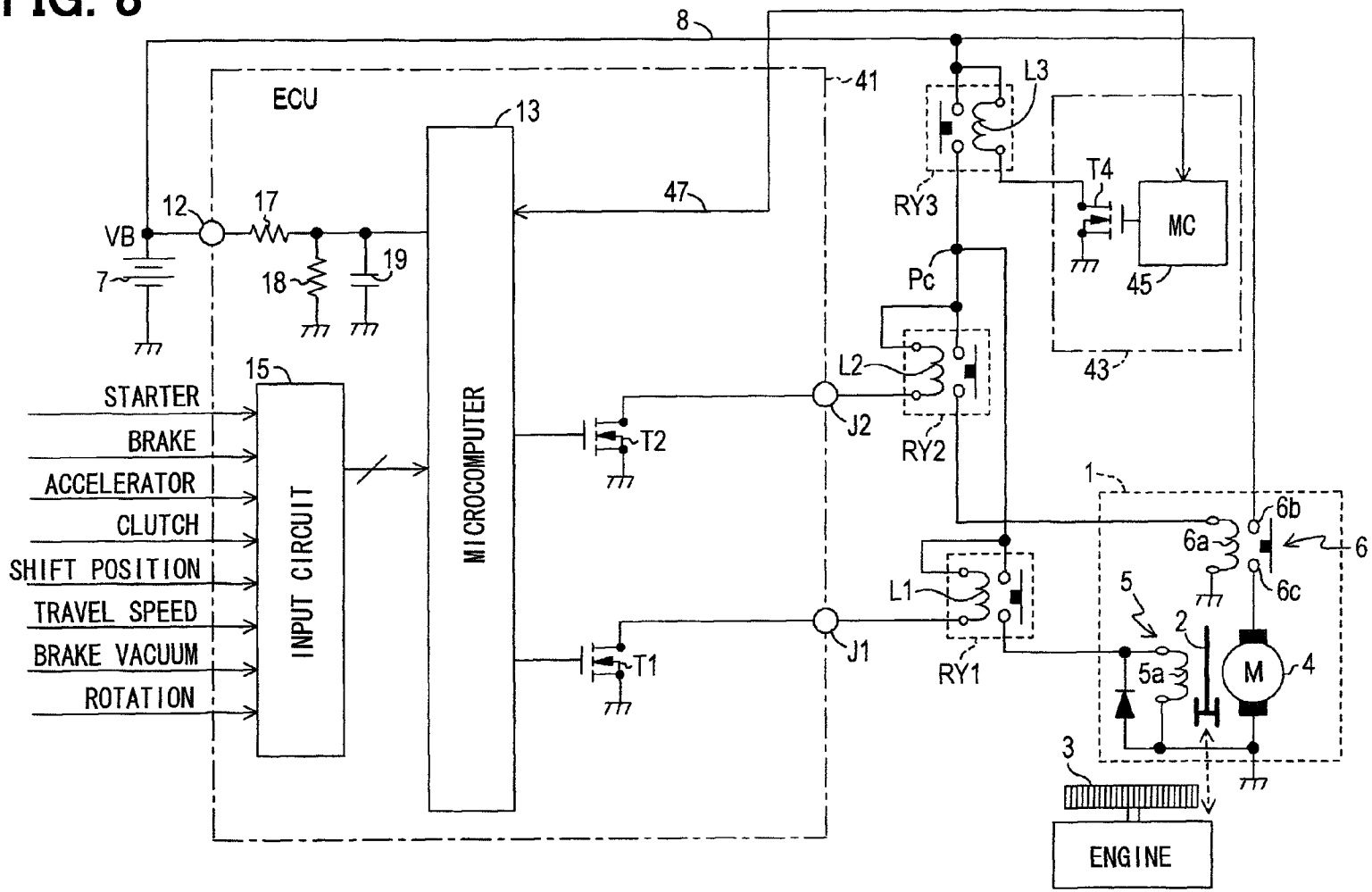
FIG. 8 is a circuit diagram showing an ECU and its peripheral devices according to a second embodiment of a starter control apparatus.

A second embodiment will be described next with reference to FIG. 8. It is noted that circuit parts, which are the same as those shown in FIG. 1 and FIG. 9, are denoted by the same reference numerals used in FIG. 1 and FIG. 9 and hence detailed description is omitted.

According to the second embodiment, the starter 1 is controlled by two ECUs 41 and 43. The ECU 41 has no transistor T3 in comparison to the ECU 11 according to the first embodiment. Instead, a relay RY3 and the ECU 43 are provided outside the ECU 41. The ECUs 41, 43 and the relay RY3 form a starter control apparatus.

The relay RY3 is an alternative to the transistor T3 in FIG. 1 (that is, forming the switching part for operation prevention) and provided in the current path, which connects the junction Pc of the upstream side ends of the coils L1 and L2 of the relays RY1 and RY2. With this configuration, the battery voltage VB is supplied to the junction Pc between the upstream side ends of the coils L1 and L2 through the relay RY3 (specifically through a movable contact of the relay RY3) when the relay RY3 is turned on.

An electric wiring is formed in the vehicle so that the current flows from the line 8 of the battery voltage VB through the relay RY3 to not only the coils L1 and L2 of the coils RY1 and RY2 but also the contacts of the relays RY1 and RY2.

The relay RY3 is thus turned on with the current flowing to the coil L3 of the relay RY3 when a transistor T4 (in this example, N-channel MOSFET) provided in the ECU 43 is turned on.

The ECU 43 also includes a microcomputer 45. The microcomputer 45 is connected to and capable of communication with the microcomputer 13 in the ECU 41 through a communication line 47. The microcomputer 45 turns on the relay RY3 by turning on the transistor T4 in response to a command from the microcomputer 13.

The microcomputer 13 in the ECU 41 thus turns on the relay RY3 by transmitting a command to the microcomputer 45 of the ECU 43 in place of turning on the transistor T3 in the starter control processing.

The microcomputer 45 in the ECU 43 checks by way of communication with the microcomputer 13 whether the microcomputer 13 is operating normally. If the check result indicates that the microcomputer 13 is not operating normally, the microcomputer 45 drives the transistor T4 to remain in the off-state irrespective of the command from the microcomputer 13. By thus preventing the relay RY3 from turning on upon detection of abnormality of the ECU 41 (microcomputer 13), the pinion gear 2 and the motor 4 are prevented from being driven to operate even when either one of both of the relays RY1 and RY2 are turned on by the ECU 41. Thus the starter 1 (pinion gear 2 and motor 4) is protected from performing erroneous operation in response to the abnormality of the microcomputer 13.

According to the second embodiment as well, the battery voltage VB is supplied to both coils L1 and L2 through one relay RY3. As a result, the relay RY3 prevents the continued engagement of the pinion gear 2 with the ring gear 3 and the continued operation of the motor 4 because of the abnormality in the power supply circuit for the coils L1 and L2. Reliability is thus improved with a small amount of additional parts.

It is also advantageous that erroneous operation prevention effect can be provided against mechanical on-failure of the relays RY1 and RY2. That is, even when one of or both of the relays RY1 and RY2 fails, the pinion gear 2 and the motor 4 is prevented from operating erroneously or unnecessarily by not turning on the relay RY3.

The relay RY3 may be provided inside one of the ECUs 41 and 43. The transistor T4 and the microcomputer 45 may be provided in the ECU 41.

The starter control apparatus is described with reference to two embodiments and modifications, it is not limited to the disclosed embodiments and modifications but may be implemented in other embodiments.

For example, in the ECU 11, the microcomputer 13 may be configured to detect a value of each monitor voltage V1 to V3 by an AD converter and detect abnormality based on the detection values (for example, by comparison with the threshold voltage Vth1 to Vth3).

The transistors T1 to T4 are not limited to MOSFETs but may be any other switching elements such as bipolar transistors or IGBTs. It is possible that a relay is used as a switching part in place of the transistor 13 in FIG. 1 and the relay in place of the transistor T3 is provided outside the ECU 11.

What is claimed is:

1. A starter control apparatus for a vehicle, in which a starter cranks an engine when a first relay and a second relay are turned on, the starter including a motor and a pinion gear, which is driven to rotate by the motor to crank the engine under a state of engagement with a ring gear of the engine, the pinion gear being switchable to a state of engagement with the ring gear and a state of non-engagement with the ring gear irrespective of an operation and non-operation of the motor, the first relay including a first coil, which is supplied with a power source voltage at one end thereof, and turning on with supply of the power source voltage to drive the pinion gear to the state of engagement with the ring gear, and the second relay including a second coil, which is connected to the one end of the first coil at one end thereof, and turning on with supply of the power source voltage to drive the motor to operate, the starter control apparatus comprising:

a first switching part provided in a first current path connecting other end of the first coil, which is opposite to the one end of the first coil, and a ground line, and turning on to render the first current path conductive thereby supplying current in the first coil to turn on the first relay;

a second switching part provided in a second current path connecting other end of the second coil, which is opposite to the one end of the second coil, and the ground line, and turning on to render the second current path conductive thereby supplying current in the second coil to turn on the second relay; and an operation preventing switching part provided in a third current path connecting a power source voltage line and a junction of the one ends of the first coil and the second coil, and turning off to render the third current path non-conductive thereby preventing an operation of the starter, wherein the first switching part, the second switching part and the operation preventing switching part are turned on to turn on the first relay and the second relay so that the starter cranks the engine.

2. The starter control apparatus according to claim 1, further comprising:

electric wiring formed to supply current from the line of the power source voltage to contacts of the first relay and the second relay without through the operation preventing switching part.

3. The starter control apparatus according to claim 1, further comprising:

a pull-up resistor having one end and other end, the one end being connected to a coil upstream side path forming the third current path between the operation preventing switching part and the junction, and the other end being connected to the line of the power source voltage;

a first pull-down resistor having one end and other end, the one end being connected to a first coil downstream side path forming the first current path between the other end of the first coil and the first switching part, and the other end being connected to the ground line;

a second pull-down resistor having one end and the other end, the one end being connected to a second coil downstream side path forming the second current path between the other end of the second coil and the second switching part, and the other end being connected to the ground line; and abnormality detection part for detecting an abnormality of a power supply circuit, which supplies the current to the first coil and the second coil, based on a first voltage of the first coil downstream side path, a second voltage of the second coil downstream side current path and a third voltage of the coil upstream side path.

4. The starter control apparatus according to claim 3, wherein:

the abnormality detection part monitors, by driving the first switching part, the second switching part and the operation preventing part to an off-state, the third voltage of the coil upstream side path, the first voltage of the first coil downstream side path and the second voltage of the second coil downstream side path, and performs all switching parts off-time abnormality detection processing at time of driving the first switching part, the second switching part and the operation preventing part to the off-state to detect the abnormality of the power supply circuit based on monitored voltages.

5. The starter control apparatus according to claim 3, wherein:

the abnormality detection part monitors, by driving the operation preventing switching part and the second switching part to an off-state and driving the first switching part to an on-state, the third voltage of the coil upstream side path, the first voltage of the first coil downstream side path and the second voltage of the second coil downstream side path, and performs first switching part on-time abnormality detection processing to detect the abnormality of the power supply circuit based on monitored voltages.

6. The starter control apparatus according to claim 3, wherein:

the abnormality detection part monitors, by driving the operation preventing switching part and the first switching part to an off-state and driving the second switching part to an on-state, the third voltage of the coil upstream side path, the first voltage of the first coil downstream side path and the second voltage of the second coil downstream side path, and performs second switching part on-time abnormality detection processing to detect the abnormality of the power supply circuit based on monitored voltages.

7. The starter control apparatus according to claim 3, wherein:

the abnormality detection part monitors, by driving the first switching part and the second switching part to an off-state and driving the operation preventing switching part to an on-state, the third voltage of the coil upstream side path, the first voltage of the first coil downstream side path and the second voltage of the second coil downstream side path, and performs operation preventing switching part on-time abnormality detection processing to detect the abnormality of the power supply circuit based on monitored voltages.

8. The starter control apparatus according claim 4, wherein:

as another processing for detecting abnormality of the power supply circuit in case of no detection of the abnormality in the all switching parts off-time abnormality detection processing, the abnormality detection part monitors, by driving the operation preventing switching part and the second switching part to the off-state and driving the first switching part to the on-state, the third voltage of the coil upstream side path, the first voltage of the first coil downstream side path and the second voltage of the second coil downstream side path, and performs first switching part on-time abnormality detection processing to detect the abnormality of the power supply circuit based on the monitored voltages.

9. The starter control apparatus according to claim 4, wherein:

as another processing for detecting abnormality of the power supply circuit in case of no detection of abnormality in the all switching parts off-time abnormality detection processing, the abnormality detection part monitors, by driving the operation preventing switching part and the first switching part to the off-state and driving the second switching part to the on-state, the third voltage of the coil upstream side path, the first voltage of the first coil downstream side path and the second voltage of the second coil downstream side path, and performs second switching part on-time abnormality detection processing to detect the abnormality of the power supply circuit based on the monitored voltages.

10. The starter control apparatus according to claim 4, wherein:

as another processing for detecting abnormality of the power supply circuit in case of no detection of abnormality in the all the switching parts off-time abnormality detection processing, the abnormality detection part monitors, by driving the first switching part and the second switching part to the off-state and driving the operation preventing switching part to the on-state, the third voltage of the coil upstream side path, the first voltage of the first coil downstream side path and the second voltage of the second coil downstream side path, and performs operation preventing switching part on-time abnormality detection processing to detect the abnormality of the power supply circuit based on the monitored voltages.

11. The starter control apparatus according to claim 3, further comprising:

idle-stop control part, provided in the vehicle, for stopping the engine when a predetermined automatic stop condition is satisfied and thereafter restarting the engine when a predetermined automatic restart condition is satisfied, wherein, when the idle-stop control part restarts the engine, all of the switching parts are turned on to drive the starter to crank the engine, and wherein, when the abnormality detection part detects the abnormality of the power supply circuit, the idle-stop control part prohibits automatic stopping of the engine.

12. The starter control apparatus according to claim 1, further comprising:

electric wiring formed to supply current from the line of the power source voltage to contacts of the first relay and the second relay through the operation preventing switching part.

13. The starter control apparatus according to claim 1, wherein:

the first relay turns on to supply a current through the contact of the first relay to an actuator for driving the pinion gear for engagement with the ring gear so that the pinion gear is engaged with the ring gear; and the second relay turns on to supply a current through the contact of the second relay to a coil of a power supply relay for supplying the current to the motor so that the power supply relay turns on to operate the motor.

14. A starter control apparatus for controlling an engine starter, which has a motor and a pinion gear separately controllable, by using a first relay and a second relay, the first relay controlling the pinion gear of the engine starter, and the second relay provided electrically in parallel relation to the first relay and controlling the motor, the starter control apparatus comprising:

a first switch provided at an electrically downstream side of the first relay and turning on to turn on the first relay;

a second switch provided at an electrically downstream side of the second relay an turning on to turn the second relay;

an operation preventing switch provided at an upstream side of the first relay and the second relay and turning off to interrupt power supply to the first relay and the second relay therethrough for preventing an operation of the starter; and an electronic control unit configured to turn on all of the first switch, the second switch and the operation preventing switch to turn on the first relay and the second relay in case of driving the starter to crank the engine.

15. The starter control apparatus according to claim 14, wherein:

the electronic control unit is further configured to monitor a first voltage developed at a terminal between the first relay and the first switch, a second voltage developed at a terminal between the second relay and the second switch and a third voltage developed at a terminal between the operation preventing switch and the first and the second relays;

the electronic control unit is further configured to perform all switches off-time abnormality detection processing by turning off all of the first switch, the second switch and the operation preventing switch and comparing first, second and third monitored voltages with first, second and third threshold voltages predetermined in correspondence to the first switch, the second switch and the operation preventing switch, respectively; and the electronic control unit is further configured to perform on-time abnormality detection processing by turning on in sequence only one of the first switch, the second switch and the operation preventing switch and comparing the first, the second and the third monitored voltages with the first, the second and the third threshold voltages, respectively.

* * * * *